US005129556A

United States Patent [19]

Gratsch

[11] Patent Number: 5,129,556

[45] Date of Patent: Jul. 14, 1992

[54] CONDENSING AND ALIGNMENT DEVICE FOR PREPARING THE EDGES OF CLOTH ELEMENTS TO BE SEWN TOGETHER

[76] Inventor: Jack M. Gratsch, 6220 Britton Ave., Cincinnati, Ohio 45227

[21] Appl. No.: 708,727

[22] Filed: May 31, 1991

Related U.S. Application Data

[63] Continuation-in-part of Ser. No. 579,849, Sep. 9, 1990, abandoned.

[51] Int. Cl.[5] ..... D05C 15/00

[52] U.S. Cl. ..... 223/52; 112/121.15; 112/308; 271/226

[58] Field of Search ..... 223/52, 1, 28; 112/121.15, 121.11, 121.12, 308, 309, 306; 271/226

[56] References Cited

U.S. PATENT DOCUMENTS

| | | | |
|---|---|---|---|
| 3,970,015 | 7/1976 | Fukuyama | 112/121.12 |
| 4,633,793 | 1/1987 | Engle | 112/308 X |
| 4,651,659 | 3/1987 | Bernardon | 112/308 X |
| 4,667,859 | 5/1987 | Gratsch | 223/52 |

*Primary Examiner*—Peter Nerbun

*Attorney, Agent, or Firm*—Frost & Jacobs

[57] ABSTRACT

A condensing and alignment device for preparing cloth elements to be joined together. The device comprises a base and a support on the base for a row of needle blocks in side-by-side relationship. At least two fabric engaging needles extend vertically upwardly on each needle block. A resilient O-ring is mounted on each needle block facing and abutting an adjacent needle block in the row, the needle blocks of the row being spaced from each other by the O-rings. A condensing cylinder is located at one end of the needle block row and is operatively attached to at least that needle block at the opposite end of the row. The needle blocks of the row are shiftable by the condensing cylinder from their normal position determined by the O-rings to a condensed position against the action of the O-rings. A press is mounted above the needle block row and is shiftable between an upper retracted position above the needle block row and a lower extended position abutting the needle blocks of the row. The press is connected to a source of steam. The base, adjacent the needle block row, is provided with a plurality of perforations connected to a source of vacuum.

46 Claims, 24 Drawing Sheets

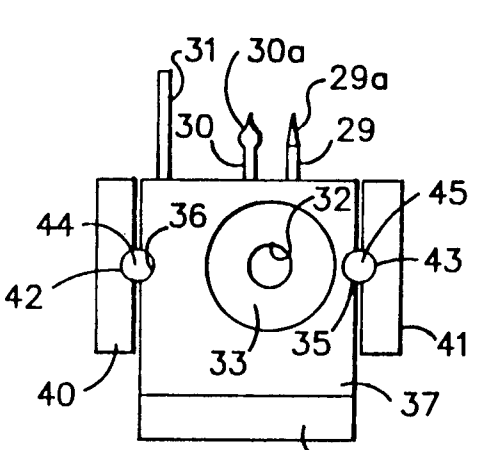
FIG. 5A
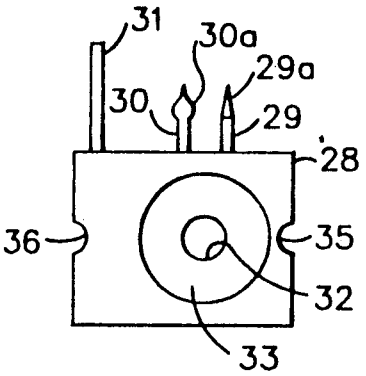
FIG. 5B
FIG. 5C
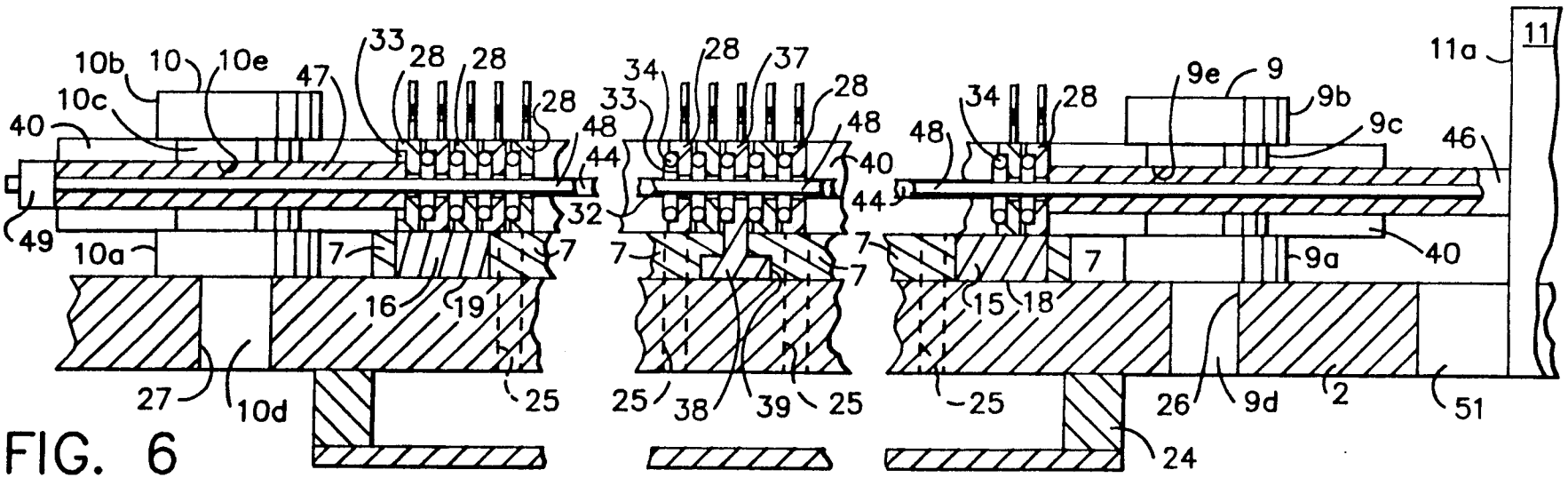
FIG. 6

CONDENSING AND ALIGNMENT DEVICE FOR PREPARING THE EDGES OF CLOTH ELEMENTS TO BE SEWN TOGETHER

REFERENCE TO RELATED APPLICATION

This is a continuation-in-part of copending application Ser. No. 07/579,849, filed Sept. 9, 1990 (now abandoned) in the name of the same inventor and entitled: A CONDENSING AND ALIGNMENT DEVICE FOR PREPARING THE EDGES OF CLOTH ELEMENTS TO BE SEWN TOGETHER TO FORM A SEAM THEREBETWEEN.

TECHNICAL FIELD

The invention relates to a condensing and alignment device for preparing the edges of cloth elements to be sewn together to form a seam, and more particularly to such a device capable of condensing one of the cloth edges if it is longer than the other, and capable of aligning the cloth edges which may be rectilinear, oppositely arcuate, or the like.

BACKGROUND ART

While not so limited, the device of the present invention will be described in its application to preparation of a suit coat front and a suit coat back to be sewn together along the shoulder seam. This particular application has been chosen because it is complex and difficult, and demonstrates the full gamut of operations of which the device is capable. The device of the present invention is capable of performing simpler seam preparation operations as will be described hereinafter.

The shoulder seam between a suit coat front and back is particularly difficult to prepare for sewing for two basic reasons. First of all, the edge of the coat back at the shoulder seam is slightly longer than the edge of the coat front. Secondly, the coat back shoulder seam edge is slightly concave, while the coat front shoulder seam edge is slightly convex. In most instances, prior art workers sewed a shoulder seam on an appropriate sewing machine while at the same time condensing the coat back edge and aligning the convex and concave edges manually without the production of ripples, bulges and the like. It will be immediately appreciated that such a sewing operation required a highly skilled person and was extremely difficult and time consuming to perform.

U.S. Pat. No. 4,667,859 in the name of the same inventor teaches a device for condensing an area of fabric, utilizing a large number of condensing needles. In this instance, however, an elongated narrow strip of the material, (i.e., the edge) is to be condensed and requires a different mechanism for this purpose.

Through the use of the device of the present invention, the preparation of the shoulder seam is very much easier, very much quicker, and far more precise. A highly skilled person is not required to operate the device. The device of the present invention may be manually controlled, or computer controlled, as desired.

DISCLOSURE OF THE INVENTION

According to the invention there is provided a condensing and alignment device for preparing cloth elements to be joined together to form a seam therebetween. The device comprises a base with a raised longitudinal central portion supporting a needle block assembly. The needle block assembly extends transversely of the raised central base portion. The needle block assembly comprises a plurality of needle blocks in side-by-side relationship, separated by a resilient O-ring mounted on each of the needle blocks. Each needle block carries at least two fabric engaging needles.

The needle block front and rear edges are confined between two flexible metallic strips affixed at their ends to pivots mounted on the base. A condensing cylinder is operatively attached to the endmost needle blocks and, when actuated, pulls the needle blocks together to a condensed position, against the action of the resilient O-rings. The needle block assembly is normally rectilinear, but can be shifted to a concave configuration or a convex configuration for engaging cloth element edges of corresponding configuration. A cylinder actuated pusher die assembly abuts the needle block assembly from one direction giving the needle block assembly a concave configuration or from the opposite direction to give the needle block assembly a convex configuration.

The device is provided with a press adapted to be shifted downwardly on top of the needle block assembly, engaging the needle blocks in any of their arcuate and rectilinear positions. The press is connected to a source of steam. The base of the device, beneath the needle block assembly, is foraminous and is connected to both a source of vacuum and a source of pressurized air.

The device just described can prepare rectilinear cloth element edges to be sewn together to form a seam. Where this is always the case, a simplified version of the device may be employed wherein the shelf and the pusher die assembly are eliminated. The needle blocks themselves are slidably mounted in a simple, rigid needle block holder, which enables them to be shifted to a condensed position by a condensing cylinder. A modification of this simplified version can be used to condense the edge of a fabric piece, even if the edge is non-rectilinear, as will be explained hereinafter.

BRIEF DESCRIPTION OF THE DRAWINGS

FIG. 5A is a side elevational view of the center needle block.

FIG. 5B is a side elevational view of a needle block other than the center one.

FIG. 5C is a side elevational view of the central needle block illustrating the flexible spring steel strips 40 and 41 and the rod-like members 44 and 45.

FIG. 6 is a fragmentary transverse cross-sectional view of the device taken through the thrust tubes 46 and 47.

DETAILED DESCRIPTION OF THE INVENTION

Figure 1A:
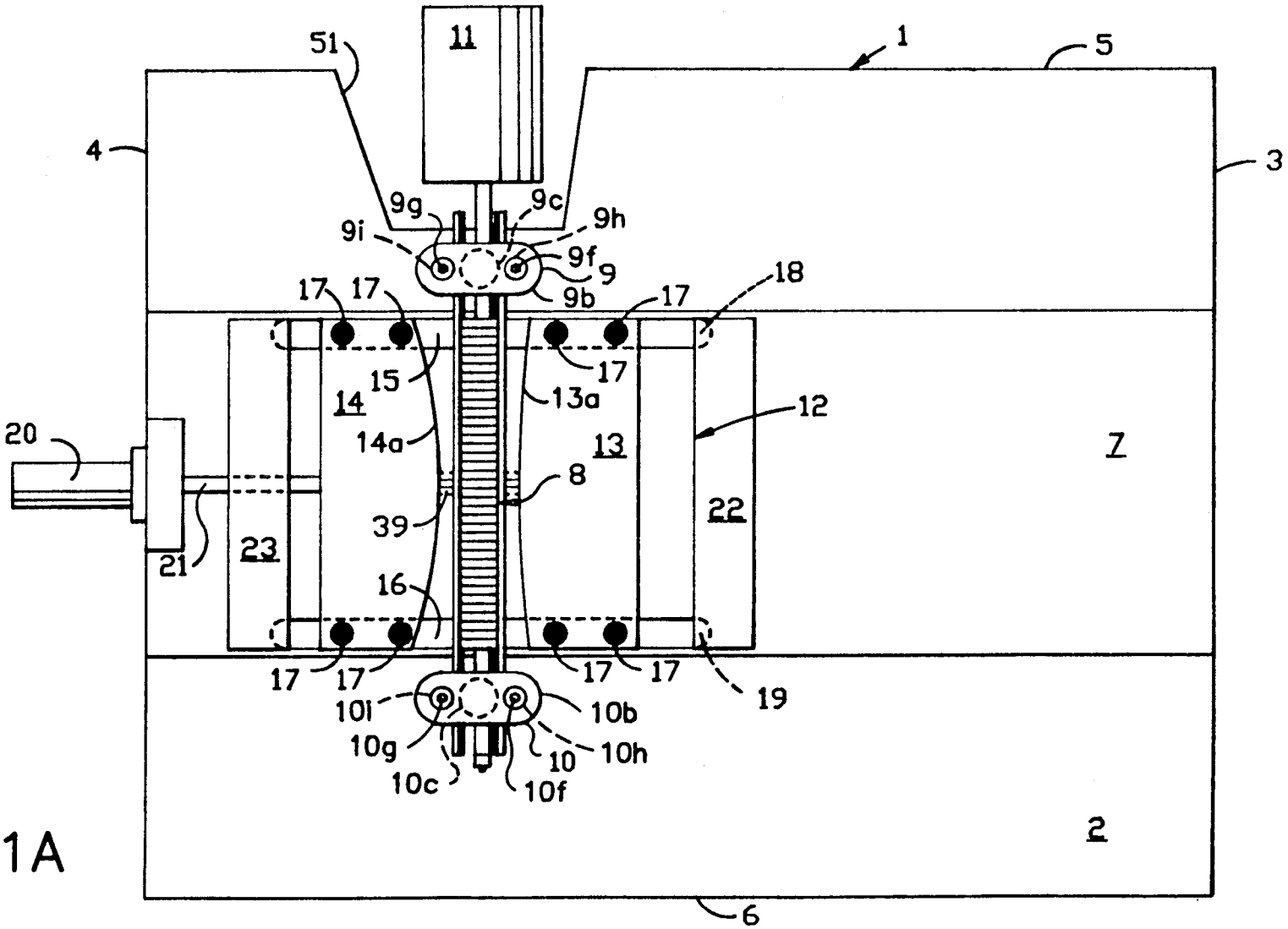
FIG. 1A is a plan view of the condensing and aligning device of the present invention with the cylinder actuated shelf removed.

Referring first to FIG. 1*a*, this Figure is a plan view of the device of the present invention with the shiftable shelf and press removed. These latter two items will be discussed in detail hereinafter.

The device of the present invention is generally indicated at 1 and comprises a main support or base 2. The base 2 has a front edge 3, a rear edge 4, and side edges 5 and 6. The base 2 has a central raised portion 7 which extends from the front edge 3 to the rearward edge 4.

A needle block assembly is generally indicated at 8. The needle block assembly extends transversely of the raised central base portion 7 with its ends mounted in pivots 9 and 10 affixed to base 2 on either side of the raised central portion 7. The needle block assembly is also provided with a condensing cylinder 11, the purpose of which will be apparent hereinafter.

Index numeral 12 generally indicates a pusher die assembly. The pusher die assembly comprises a front pusher die 13 having an arcuate pushing surface **13*a* and a rear pusher die 14, having an arcuate pusher surface 14*a*. It will be noted that the usher dies 13 and 14 lie forwardly and rearwardly of the needle block assembly 8, respectively, with their arcuate surfaces 13*a* and 14*a* facing the needle block assembly 8. The pusher dies 13 and 14 are joined together by a pair of rails 15 and 16 affixed to the underside of pusher dies by appropriate bolts 17, or the like. The rails 15 and 16 are slidably mounted in grooves or slots 18 and 19 formed in the upper base element 7. This is clearly shown, for example, in FIGS. 4 and 6**.

Since the front pusher die 13 and rear pusher die 14 are joined together by rails 15 and 16, they are shiftable as a unit toward the front edge 3 of base 2 and toward the rear edge 4 of base 2 by a pusher die assembly cylinder 20 having a piston rod 21 affixed to the rearward edge of rear pusher die 14. Cylinder 20 is preferably an air cylinder of the double acting type. Cylinder 20 is connected to a source of pressurized air (not shown) and appropriate control valve means (not shown). The extent of the forward movement of pusher assembly 12 toward the front edge 3 of base 2 is determined by stop block 22. Similarly, the extent of rearward movement of the pusher assembly 12 toward the rear edge 4 of base 2 is determined by stop block 23. Stop blocks 22 and 23 extend transversely of the upper base element 7 and are appropriately affixed thereto. Both of the stop blocks 22 and 23 may be adjustably mounted on upper base element 7 so as to lengthen or shorten the strokes of the pusher assembly.

Figure 1B:
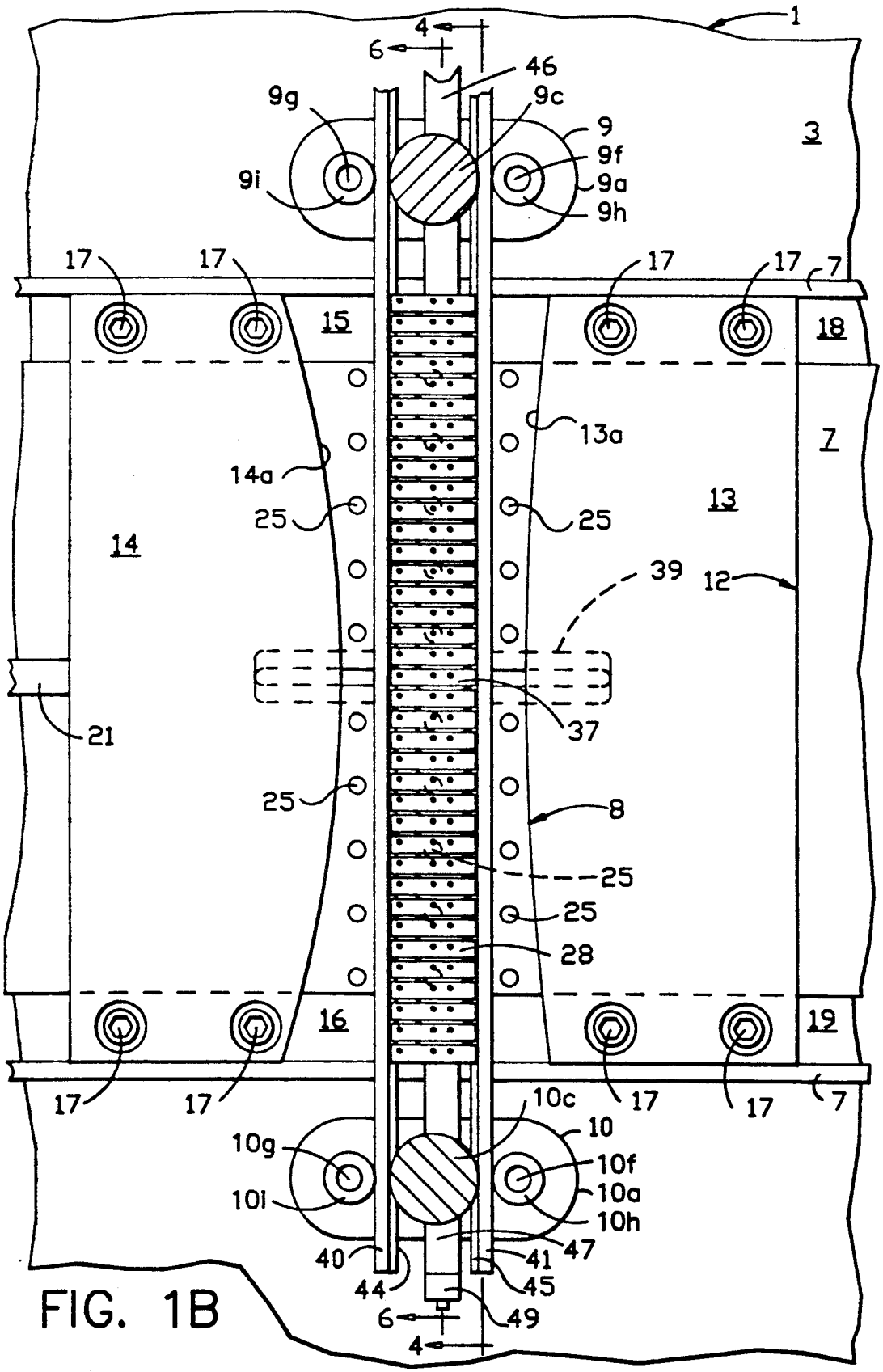
FIG. 1B is an enlarged fragmentary view of the needle block assembly and the pusher die assembly.
Figure 3:
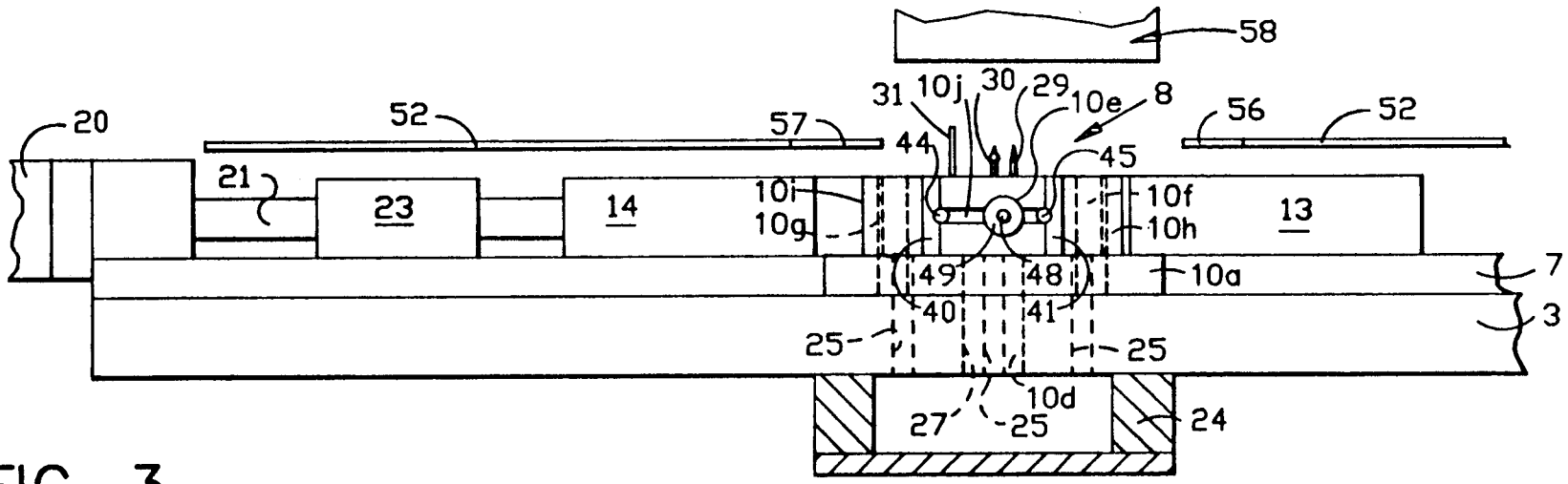
FIG. 3 is a fragmentary side elevational view, partly in cross section, as seen from the bottom of FIG. 2A.
Figure 8A:
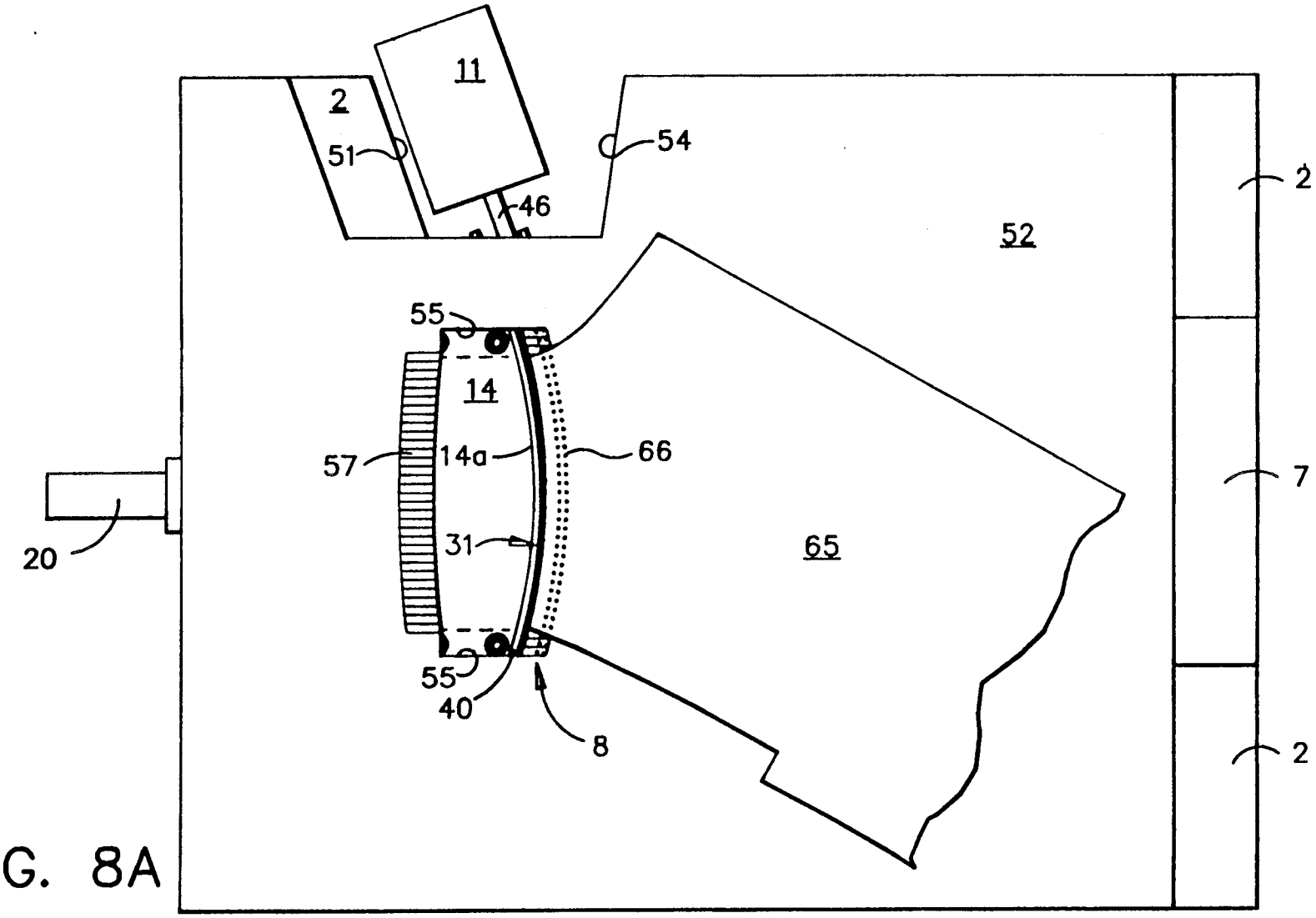
FIG. 8A is a plan view of the device illustrating the edge of the suit coat back mounted on the needle block assembly.
Figure 8B:
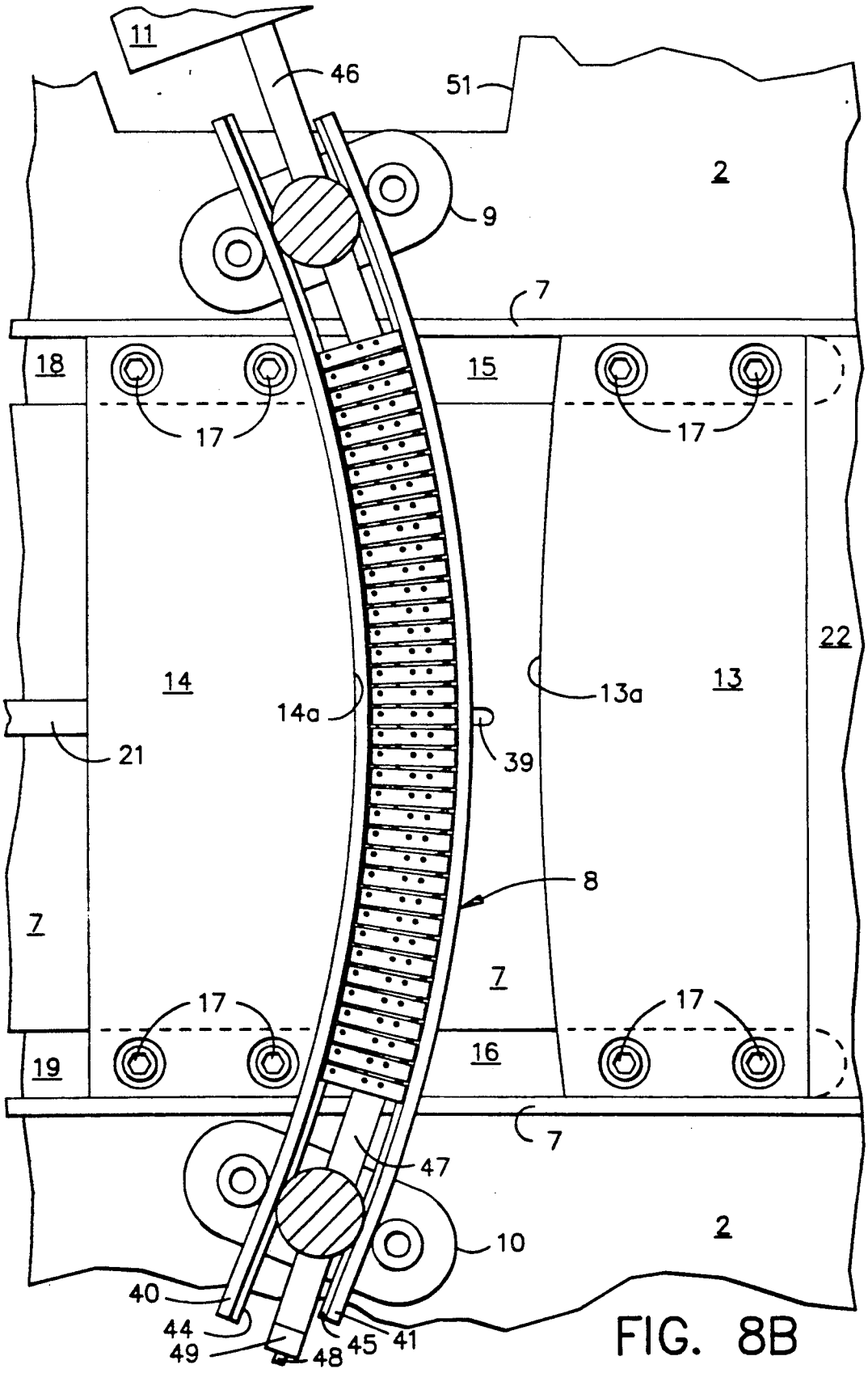
FIG. 8B is a fragmentary plan view illustrating the needle block in its concave configuration.
Figure 8C:
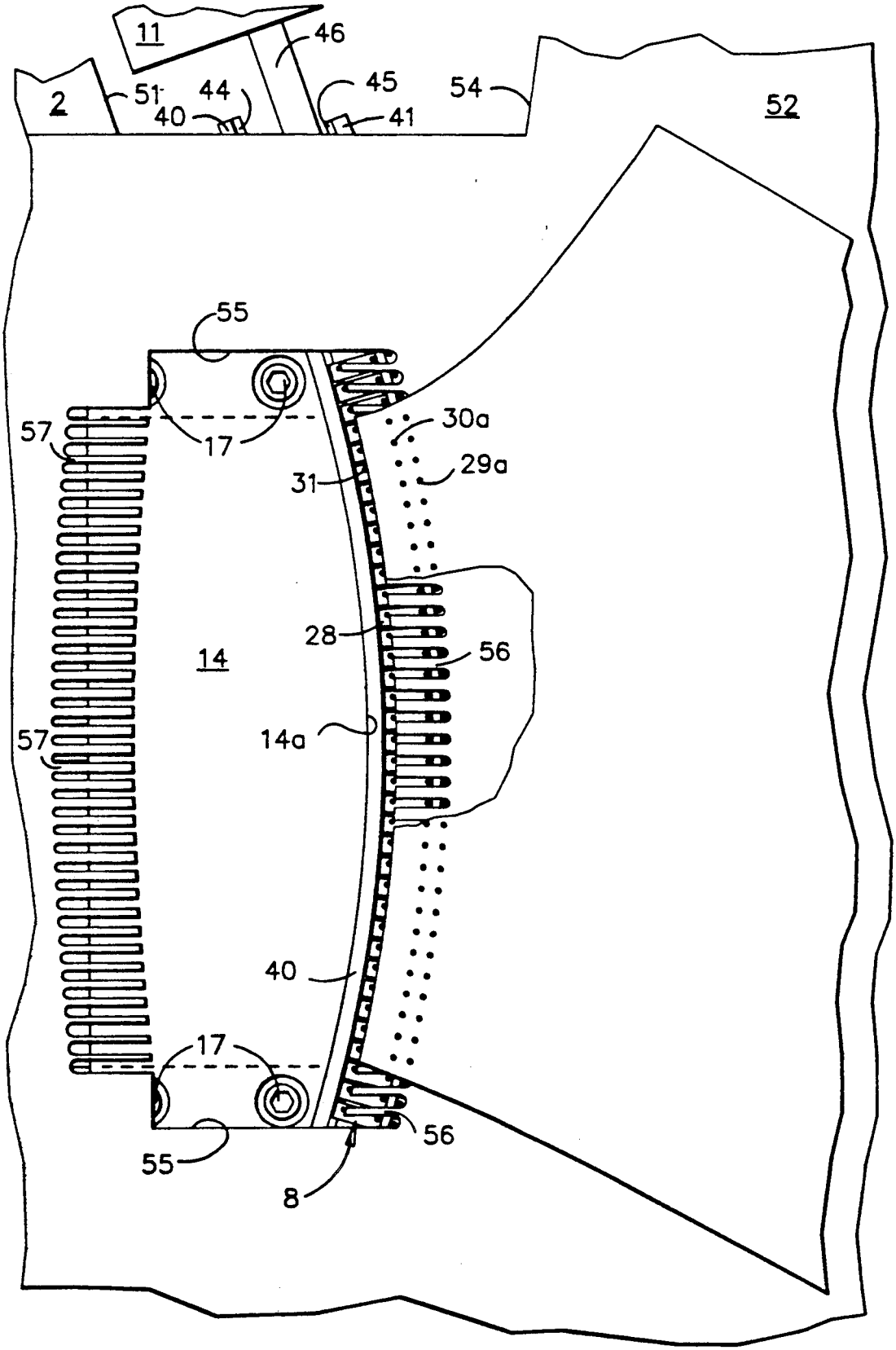
FIG. 8C is an enlarged fragmentary view illustrating the edge of the suit coat back mounted on the needle block assembly.

Reference is now made to FIGS. 1A, 1B and 3. It will be noted that, as viewed from the front of the device, (i.e., from the right of FIGS. 1A, 1B and 3), the edge **13*a* of front pusher die 13, facing the needle block assembly 8, is an arcuate convex edge. When the pusher assembly is shifted by cylinder 20 to the left in these figures, the needle block assembly 8 will take on an arcuate configuration as shown in FIG. 13C. Similarly, that edge 14*a* of rear pusher block 14 which faces the needle block assembly 8 is an arcuate concave edge when viewed from the front of the device. When the pusher assembly 12 is shifted to the right in FIGS. 1A, 1B and 3, the needle block assembly will take on an arcuate concave configuration, as illustrated in FIG. 8B. The reason for this shifting of the needle block assembly 8** will be apparent hereinafter.

Figure 12A:
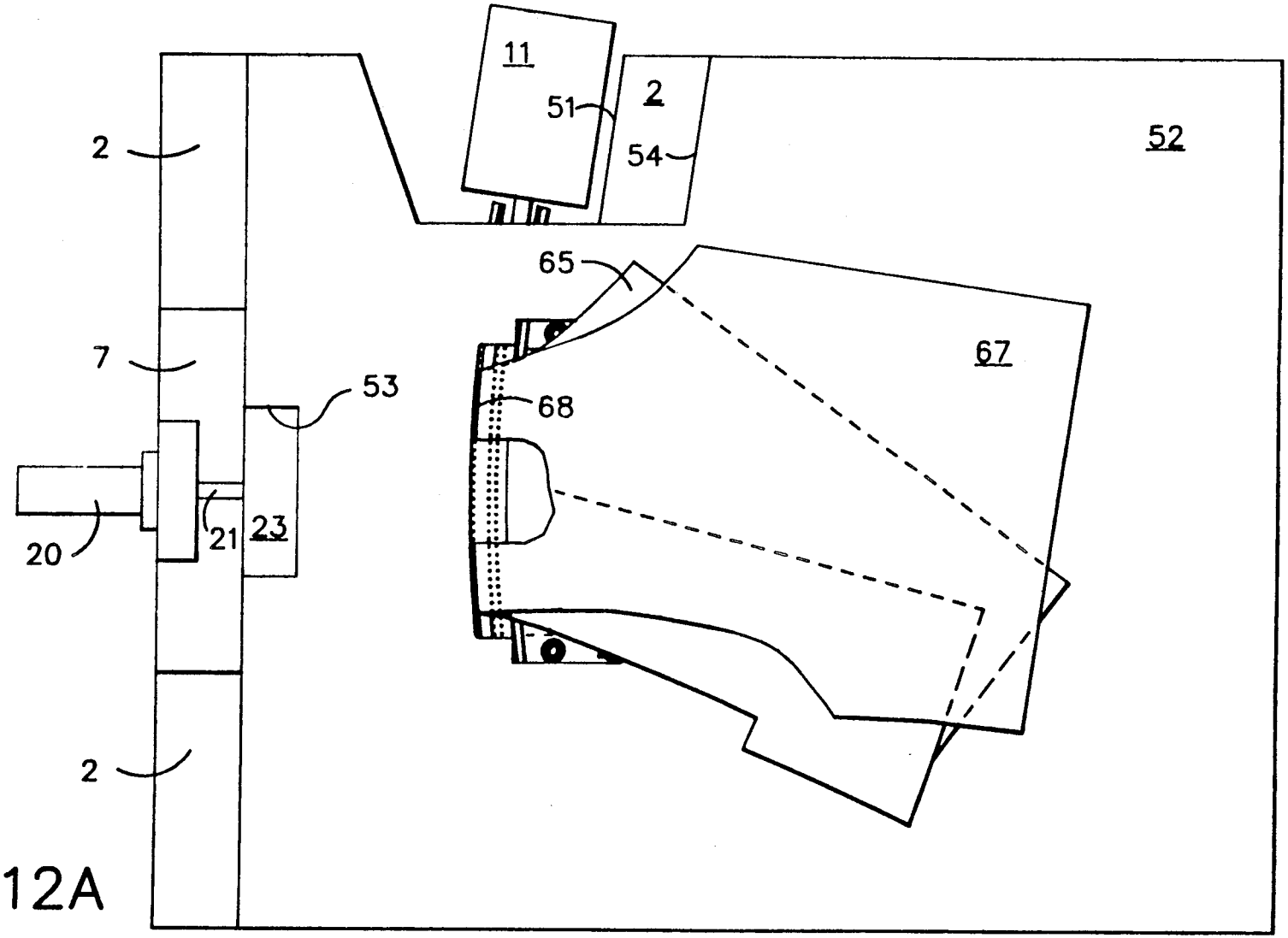
FIG. 12A is a plan view of the device with the edge of the coat front affixed to the needle block assembly.
Figure 12B:
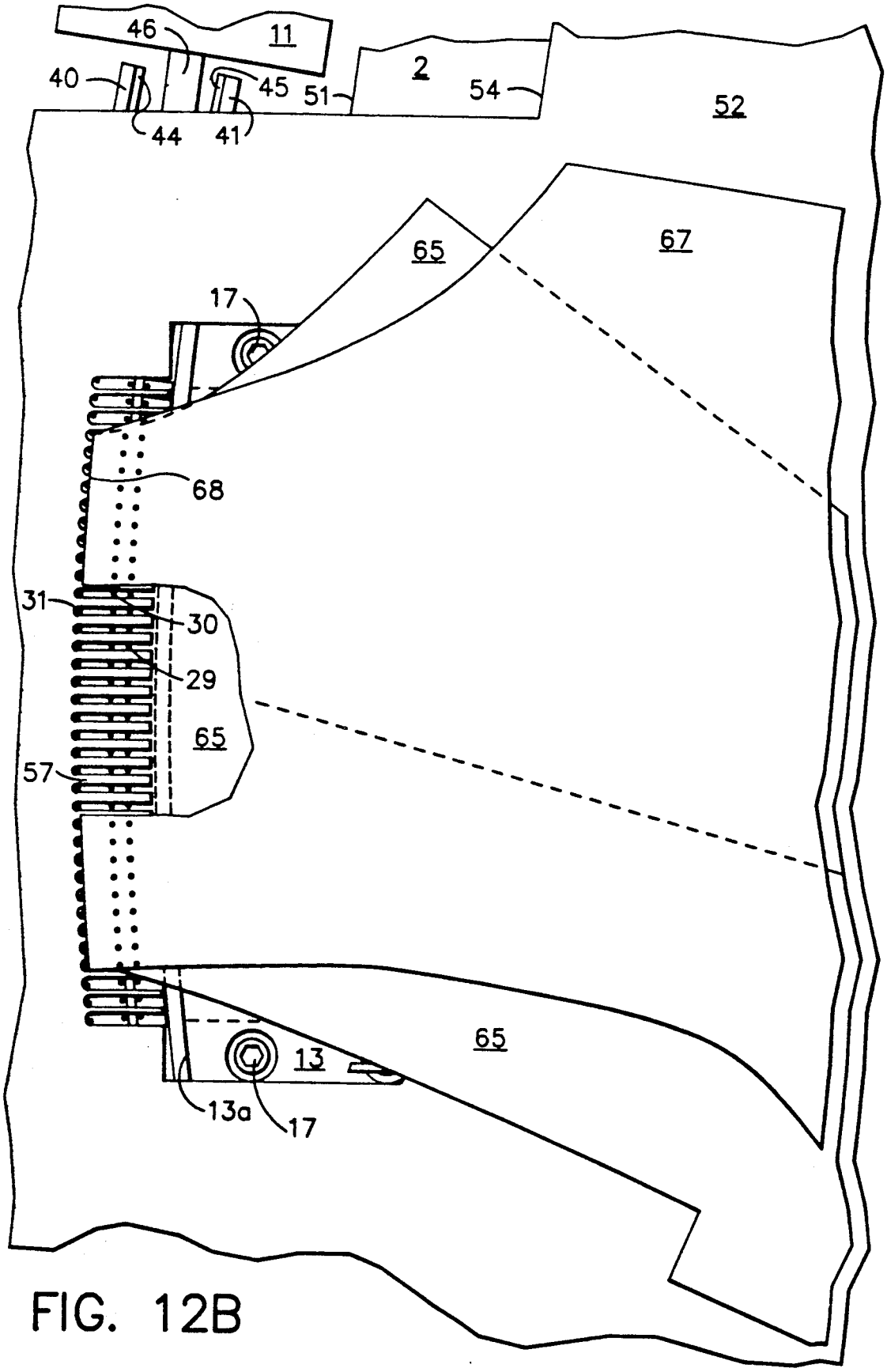
FIG. 12B is an enlarged view illustrating the needle block assembly with the edge of the coat front mounted thereon.
Figure 12C:
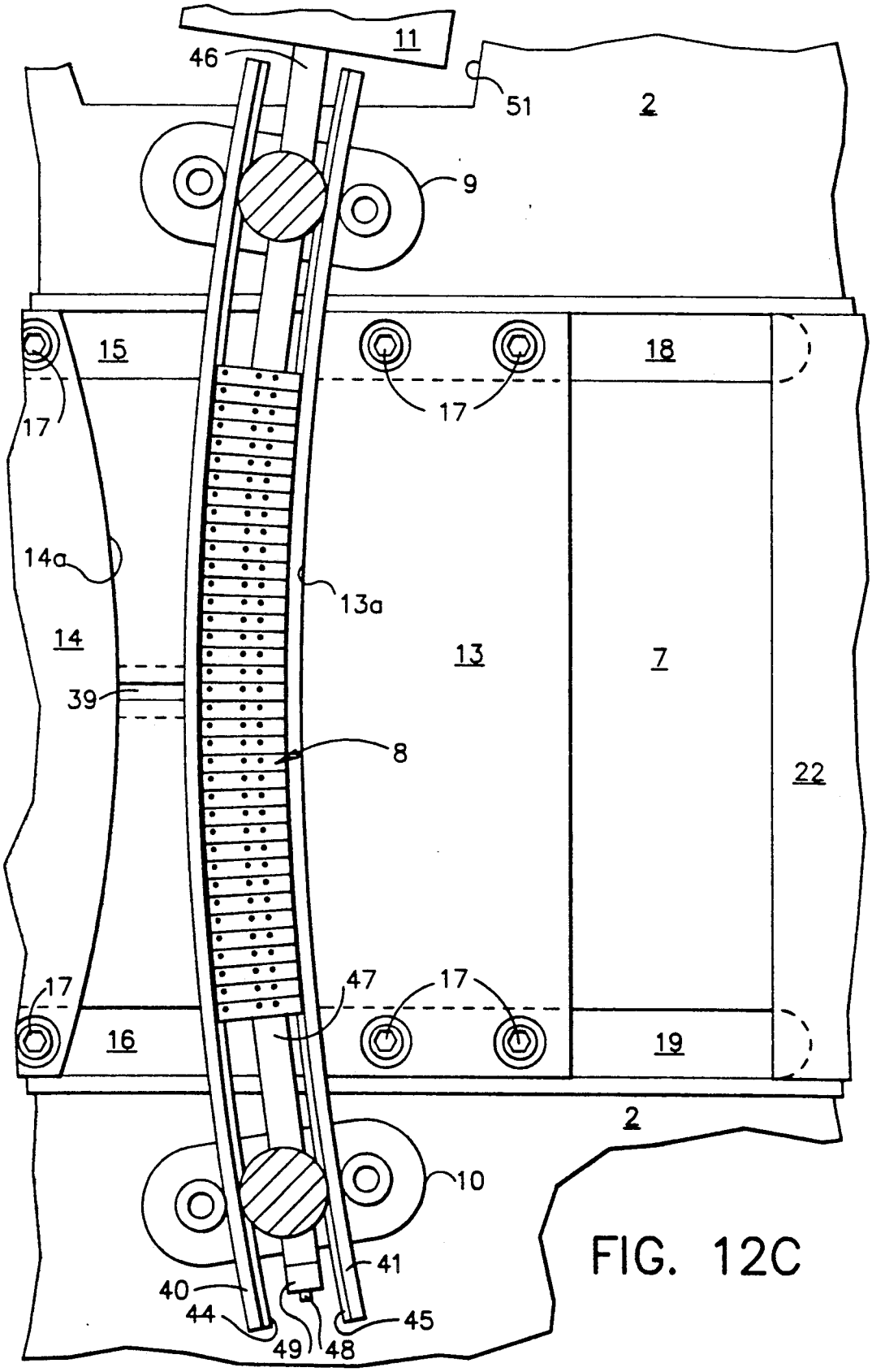
FIG. 12C is an enlarged fragmentary view illustrating the needle block assembly in its convex position.

The base 2 is provided with a chamber 24 located therebeneath. A plurality of bores or perforations 25 are formed in the upper base portion 7 and base 2 and connect with chamber 24. The chamber 24 is connected (not shown) to a source of vacuum and a source of air under pressure for reasons which will be apparent hereinafter. The perforations 25 are so arranged as to underlie the needle block assembly 8 when in its normal position as shown in FIG. 1B, its concave position as shown in FIG. 8B, and its convex position as shown in FIG. 12C.

Figure 4:
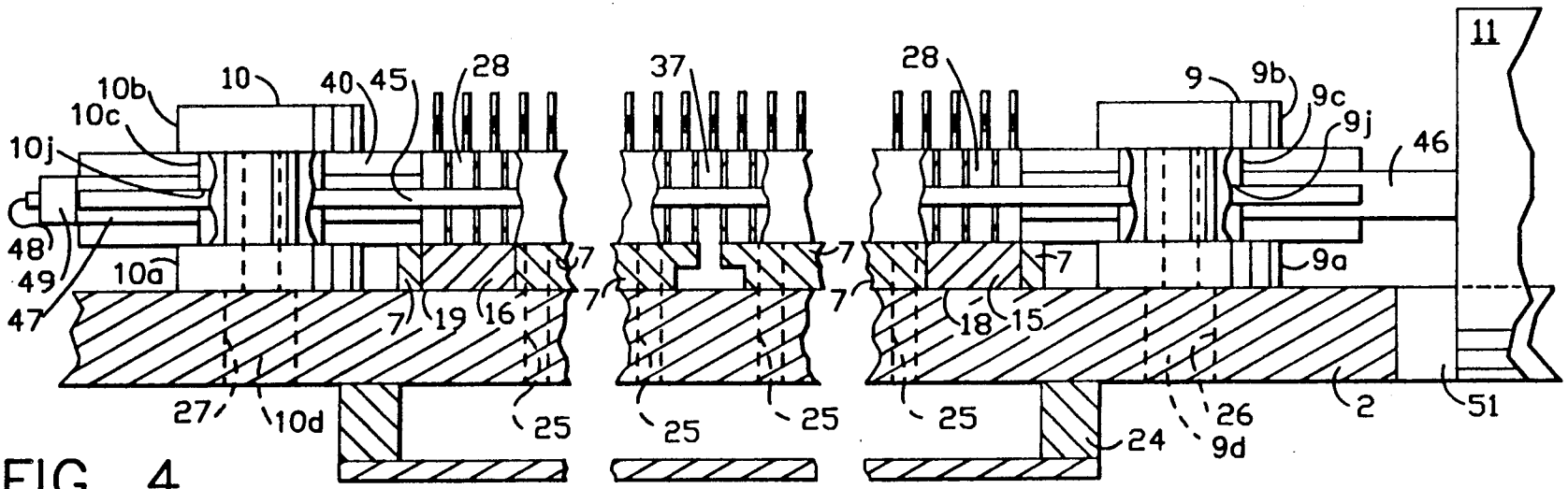
FIG. 4 is a fragmentary cross-sectional view taken transversely of the device through the needle block assembly.

As indicated above, the needle block assembly 8 is supported by a pair of pivots 9 and 10. The pivots 9 and 10 are identical. Therefore, a description of pivot 9 can also suffice as a description of pivot 10. pivot 9 is best shown in FIGS. 1A, 1B and 6. Pivot 9 comprises a lower obround plate 9*a* and an identical upper obround plate 9*b*. The upper and lower obround plates 9*a* and 9*b* are held in parallel spaced relationship by a cylindrical portion 9*c*. The lower obround plate 9*a* is provided with a stem 9*d* which is rotatively mounted in a perforation 26 in base 2, rendering the pivot 9 rotatable. The cylindrical portion 9*c* is provided with an off-center transverse perforation 9*e*, the purpose of which will be apparent hereinafter. Reference is now made to FIG. 1B wherein the upper plate 9*b* has been removed for purposes of clarity. A pair of vertical shafts 9*f* and 9*g* extend vertically between and are affixed to plates 9*a* and 9*b*. The shafts 9*f* and 9*g* lie to either side of cylindrical portion 9*c* and are spaced therefrom. The shaft 9*f* carries a roller 9*h*. Similarly, the shaft 9*g* carries a roller 9*i*. The rollers 9*h* and 9*i* are in parallel spaced relationship with respect to each other and with respect to the central cylindrical portion 9*c*. The pivot 9 is completed by the provision of an annular groove about its cylindrical portion 9*c*. This annular groove is illustrated in FIG. 4 at 9*j*.

pivot 10, being identical to pivot 9, has its like parts numbered 10*a* through 10*j*.

The needle block assembly 8 comprises a plurality of identical needle blocks, one of which is shown in FIG. 5*b* at 28. Needle block 28 comprises a narrow rectangular metallic block supporting a pair of short needles 29 and 30 and an elongated needle 31. Short needle 29 is provided with a conventional conical point 29*a*. Short needle 30 may be provided with a similar point, although it is preferable that the base of the conical point be slightly larger than the shaft of the needle 30. Such a point is shown at 30*a*. The elongated needle 31 may be provided with a conical point, or may be substantially blunt as shown in FIG. 5*b*.

The needle block is provided with a transverse perforation 32. On one of its sides, needle block 28 has an annular depression surrounding perforation 32. The annular depression 33 is adapted to receive an O-ring 34. This is illustrated in FIG. 6, which is a cross-sectional view taken through the center of perforation 32. Finally, needle block 28 is provided with semi-circular notches 35 and 36 located in its forward and rearward edges.

All of the needle blocks are identical except the centermost one in the row. The centermost needle block is illustrated in FIG. 5A and is indicated at 37. Center needle block 37 differs from the remaining needle blocks 28 only in that its vertical dimension is slightly greater and the lower end 38 of center needle block 37 is of an inverted T-shaped cross section. The remainder of the elements of center needle block 37 have been given the same index numerals as the other needle blocks 28.

FIG. 4 is a cross-sectional view taken along section line 4—4 of FIG. 1B. FIG. 6 is a cross-sectional view taken along section line 6—6 of FIG. 1B. In both of these figures, it is apparent that all of the needle blocks are arranged in a side-by-side row and are slightly spaced from each other by the O-rings 34. The inverted T-shaped bottom edge 38 of center needle block 37 rides in an inverted T-shaped slot 39 formed in upper base portion 7 of the device. T-slot 39 is clearly shown in FIGS. 1A and 1B. As a consequence of this arrangement, the center needle block 37 is guided by T-slot 39 and remains parallel to the side edges 5 and 6 of the device 1 when the needle block assembly 8 is in its normal position shown in FIGS. 1A and 1B, or in its concave condition as shown in FIG. 8B, or its convex position as shown in FIG. 13C.

Figure 7:
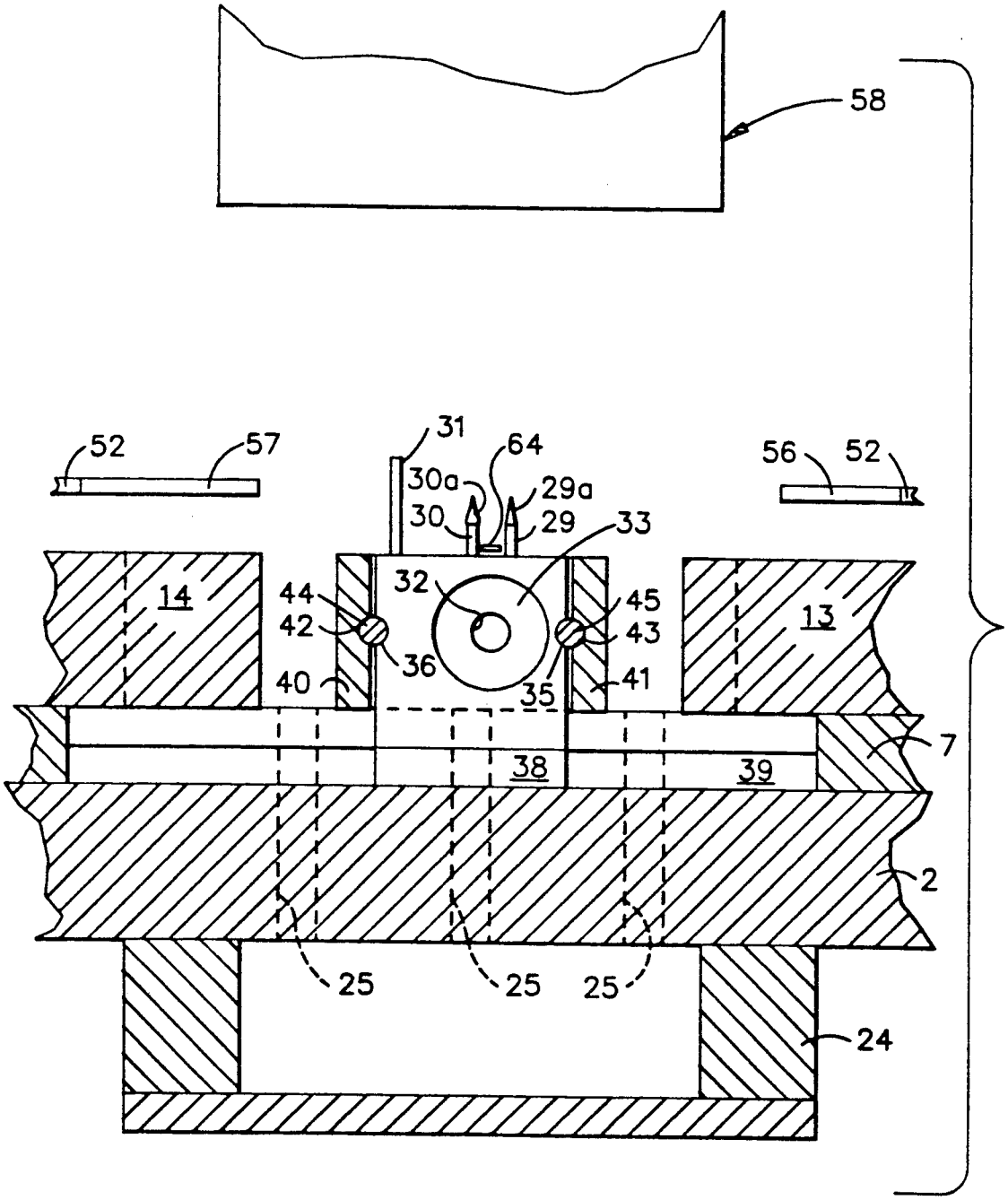
FIG. 7 is a fragmentary longitudinal cross-sectional view illustrating the central needle block and the press.

Reference is now made to FIGS. 1B, 5C and 7. It will be apparent (particularly from FIG. 1B) that the needle blocks 37 and 28 are maintained in a row by a pair of flexible spring steel strips 40 and 41. The spring steel strips 40 and 41 confine the front and rear edges of the needle blocks. As is apparent in FIGS. 5C and 7, the steel strips 40 and 41 have longitudinal semi-circular grooves 42 and 43 formed therein, respectively. The grooves 42 and 43 correspond to needle block grooves 36 and 35, respectively. A spring steel rod-like member 44 is engaged in the groove 42 of strip 40 and the grooves 36 of the needle blocks. Similarly, a spring steel rod-like member 45 is engaged in the groove 43 of strip 41 and the grooves 35 of the needle blocks. By virtue of this arrangement, the needle blocks are precluded from vertical displacement.

As is most clearly shown in FIGS. 1B and 3, the spring steel strip 40 and its spring steel rod 44 pass between the roller 10*i* and the central cylindrical portion 10*c* of pivot 10. Spring steel rod 44 is accommodated by the annular groove 10*j* of the cylindrical portion 10*c* of pivot 10. Similarly, spring steel strip 41 and spring steel rod 45 are located between roller 10*h* and central cylindrical portion 10*c* of pivot 10, the spring steel rod 45 also being accommodated by the annular groove 10*j* in the cylindrical portion 10*c* of pivot 10. As will be apparent from FIG. 1B, the other ends of spring steel strips 40 and 41 and their respective spring steel rods 44 and 45 are similarly engaged by pivot 9.

Reference is now made to FIG. 6. The condensing cylinder 11 is provided on its forward face 11*a* with a thrust tube 46. The right hand end of thrust tube 46 (as viewed in FIG. 6) is affixed to the forward face 11*a* of condensing cylinder 11. The left end of thrust tube 46 abuts the right hand most needle block 28 (as viewed in FIG. 6). The thrust tube 46 is mounted in perforation 9*e* of cylindrical portion 9*c* of pivot 9, and is longitudinally shiftable therein.

In similar fashion, a thrust tube 47 is mounted in the transverse perforation 10*e* of cylindrical portion 10*c* of pivot 10 and is longitudinally shiftable therein. The right end (as viewed in FIG. 6) of thrust tube 47 abuts the annular depression 33 of the lefthand most needle block (as viewed in FIG. 6). It will be noted that this lefthand most needle block is not provided with an O-ring 34. A cable or piano wire 48 is provided at its lefthand most end (as viewed in FIG. 6) with a termination element 49 which abuts the lefthand most end of thrust tube 47. The cable 48 passes through thrust tube 47, the perforation 32 of each needle block and thrust tube 46. The right-hand most end (not shown) of the cable 48 is affixed to a piston (not shown) within condensing cylinder 11. While condensing cylinder 11 may be of the double acting type, it can also be a single acting piston having an air inlet and outlet (not shown) adjacent the forward end of the cylinder and a return spring (not shown) on the opposite side of the piston.

When the cylinder 11 is in its normal, unactuated condition, the cable is of such length that thrust tubes 46 and 47 maintain needle blocks of the row thereof in abutment, each needle block (save the right-hand most needle block) abutting the O-ring 34 of the adjacent needle block. It will be apparent that the condensing cylinder 11 is supported by its thrust tube 46 mounted in the transverse perforation 9e of pivot 9. Thus, condensing cylinder 11 is not only free to swing with pivot 9, but also is capable of shifting toward and away from pivot 9. The base 2 is provided with a notch 51 to accommodate for these motions of condensing cylinder 11. The swinging movement of condensing cylinder 11 is illustrated, for example, in FIGS. 8B and 13C.

Figure 11A:
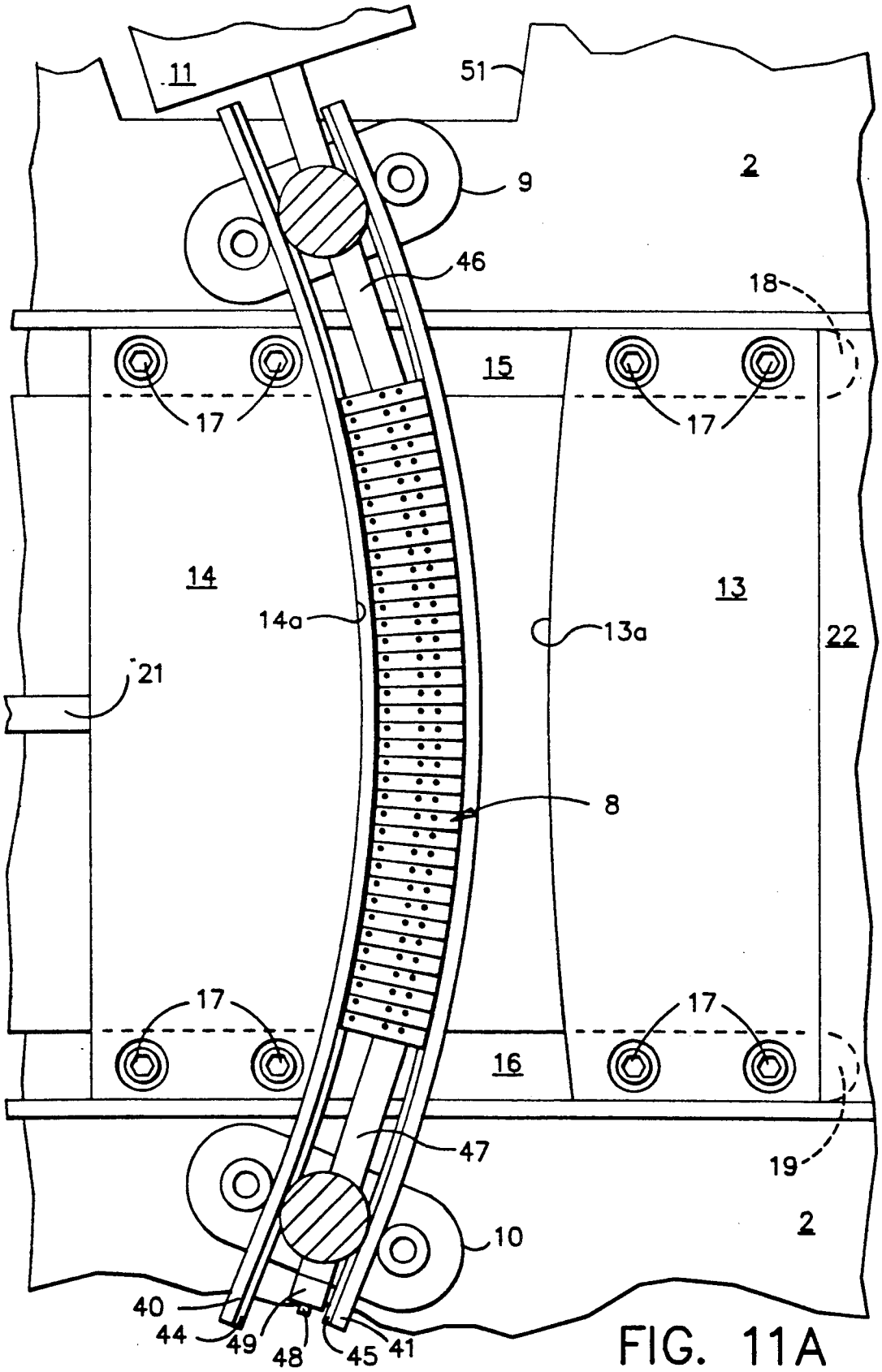
FIG. 11A is a fragmentary plan view, similar to FIG. 8B, but illustrating the needle blocks in their condensed position.

FIGS. 6 and 8B illustrate condensing cylinder 11 in its unactuated condition and the needle blocks 28 and 37 in their normal condition, spaced from each other by resilient O-rings 34. As will be apparent from FIG. 6, if cylinder 11 is actuated by air under pressure, so that its piston (not shown) is shifted to the right (as viewed in FIG. 6) cable 48 will be pulled toward the right. As a result of this, the cable terminating element 49 and thrust tube 47 will cause those needle blocks to the left of center needle block 37 to shift toward needle block 37 against the action of their respective resilient O-rings 34. At the same time, the air under pressure between the forward end of condensing cylinder 11 and its piston will cause the condensing cylinder 11 and its thrust tube to shift to the left (as viewed in FIG. 6) causing those needle blocks to the right of center needle block 37 to shift to the left toward needle block 37 against the action of their respective resilient O-rings 34. As a result of this, the space between the needles of adjacent needle blocks will be diminished, and the needle blocks will assume their condensed position. In order to appreciate this, reference is made to FIGS. 8B and 11A. In FIG. 8B, the needle blocks are shown in their normal positions. In FIG. 11A, the needle blocks are shown in their condensed positions. The purpose of this shifting of the needle blocks between normal and condensed positions will be apparent hereinafter. In some instances, it is preferred that one or more of the needle blocks near each end of the row thereof shift toward each other by a lesser amount than the remainder of the needle blocks when the needle blocks are in their condensed positions. This can be regulated by inserting inverted U-shaped shims (not shown) between the desired number of endmost needle blocks and about their respective O-rings.

Figure 2A:
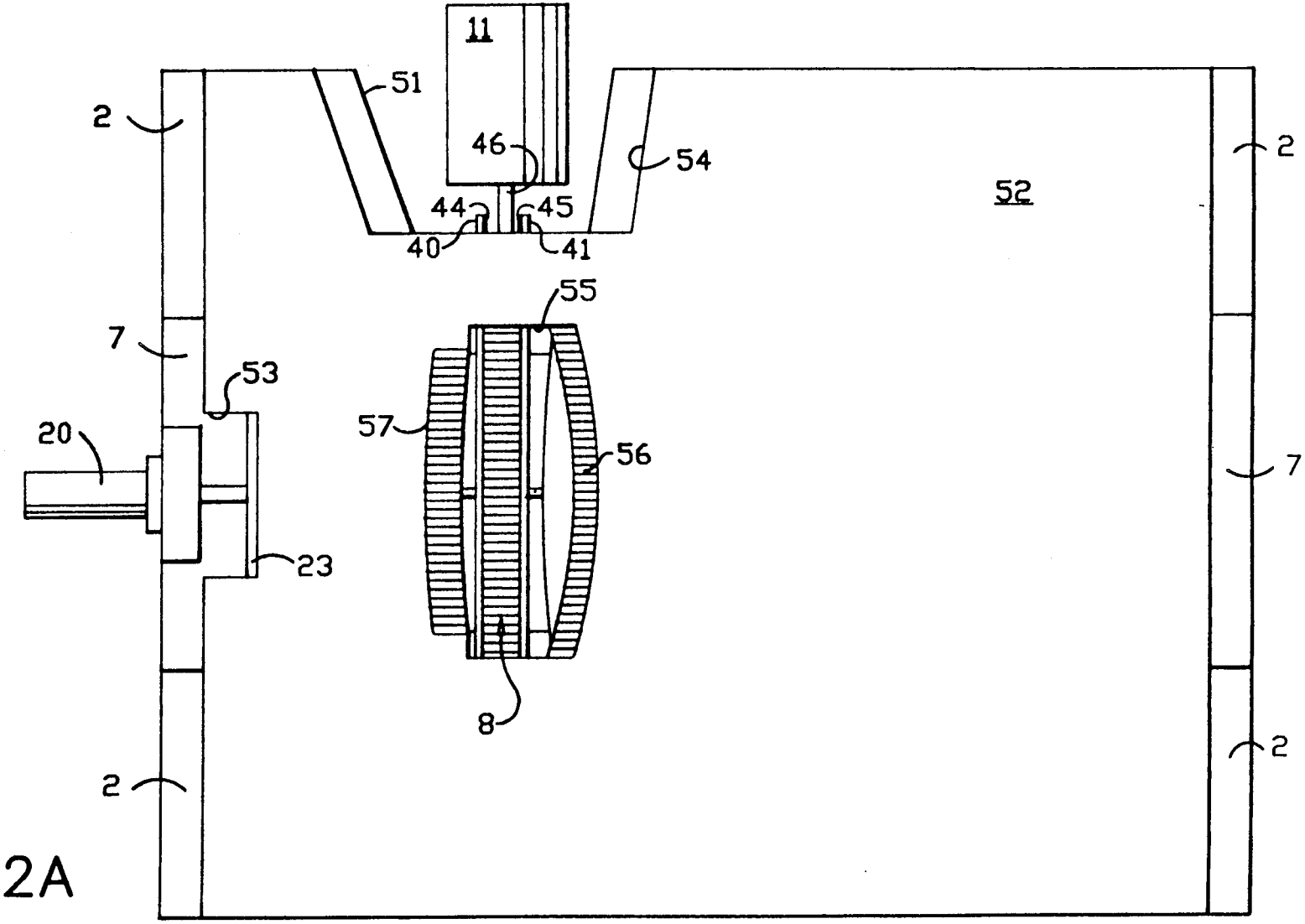
FIG. 2A is a plan view, similar to FIG. 1*a*, and illustrating the device with the shelf in place.

The device 1 of the present invention is provided with a substantially planar, panel-like shelf 52. The shelf 52 is illustrated in FIG. 2A. The shelf is adapted for longitudinal shifting to the left and to the right (as viewed in FIG. 2A) and is shiftable by hand, or preferably by means of an air cylinder (not shown) attached thereto. The shelf 52 is provided with a notch 53 to accommodate air cylinder 20 when shifted to its leftmost position (as viewed in FIG. 2A). The shelf 52 is provided with a second notch 54 to accommodate condensing cylinder 11 when the shelf is shifted either to the left or to the right and to further accommodate the shifting of cylinder 11, itself. The shelf 52 has an opening 55. The opening 55 extends transversely of shelf 52 and is provided at one of its edges with a plurality of spaced fingers 56, and at its opposite edge with a second set of fingers 57.

Figure 2B:
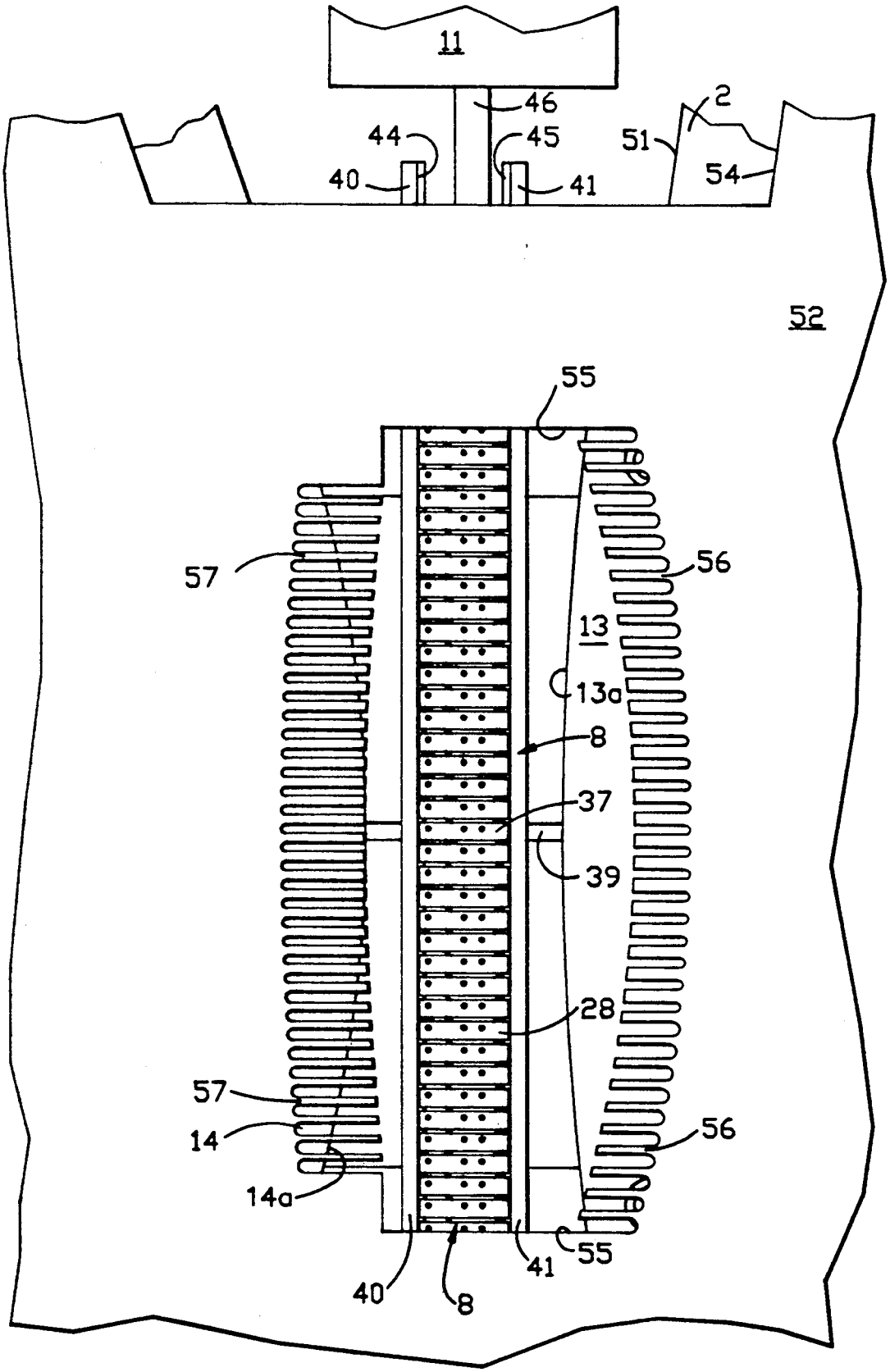
FIG. 2B is a fragmentary enlarged view of needle block assembly and the shelf.
Figure 9:
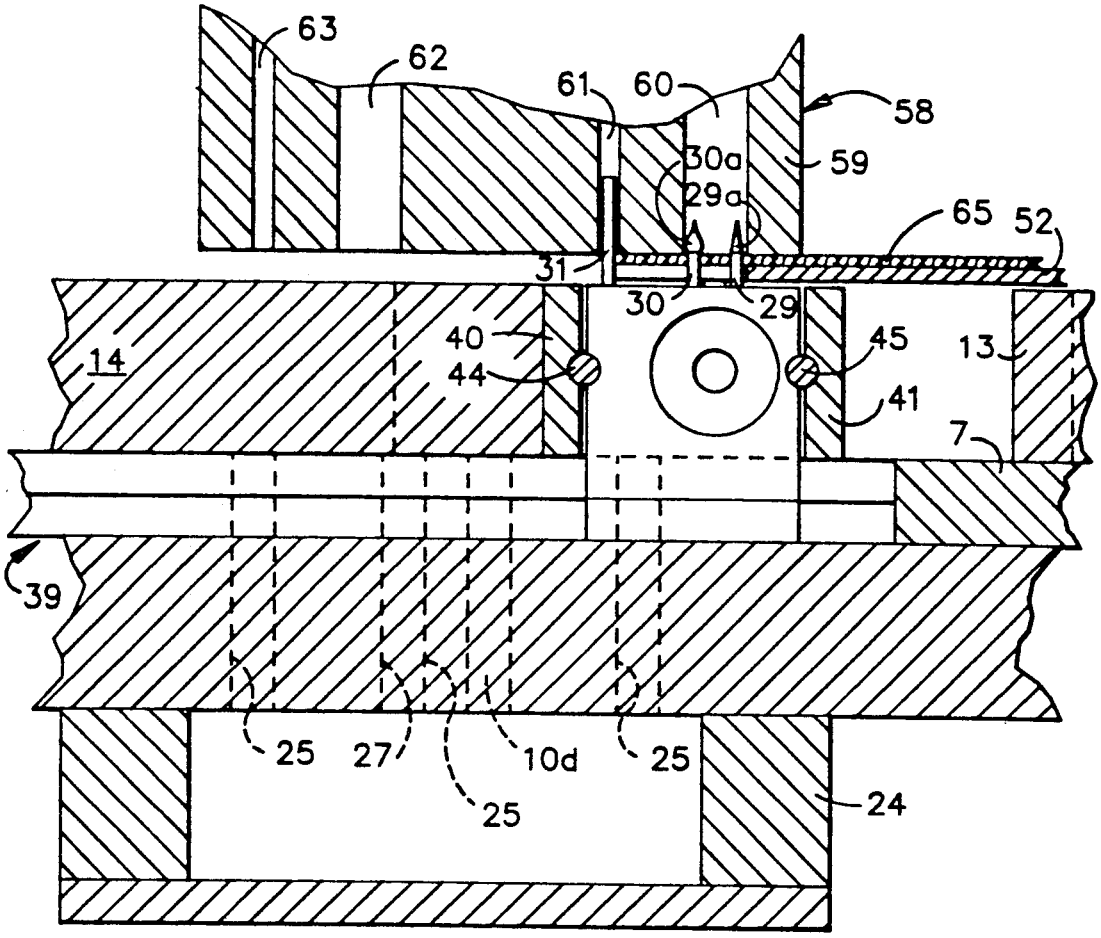
FIG. 9 is a fragmentary longitudinal cross-sectional view of the device with the press in its lowered position.

As viewed from the right of FIG. 2B, it will be noted that the fingers 56 are arranged in a concave arc and are spaced from each other by a distance slightly greater than the spacing of fingers 57. The overall row of fingers 56 is also longer than the row of fingers 57. The fingers 57, on the other hand, are arranged in a convex arc. The arrangement and spacing of the fingers 56 are such that when the needle block assembly 8 is in the configuration illustrated in FIG. 8B, by virtue of rear pusher die 14, the shelf 52 may be shifted to the left (as viewed in FIG. 2B) so that the fingers 56 can extend up to the long needles 31 of the needle block assembly with the spaces between fingers 56 aligning with the short needles 29 and 30. As can be appreciated from FIGS. 3 and 7, when the shelf 52 is in its normal horizontal position, the long needles 31 extend thereabove, but the shelf, itself, extends above short needles 29 and 30. As is shown in FIG. 9, however, the shelf 52 can be depressed so that the short needles 29 and 30 extend above the upper surface of the shelf. The purpose of this will be apparent hereinafter.

When the needle block assembly 8 is in the configuration illustrated in FIG. 12C, by virtue of both the action of the condensing cylinder 11 and the action of front pusher die 13, the shelf 52 can be shifted to the right (as viewed in FIG. 2B) so that the long needles of the needle blocks extend upwardly through spaces between fingers 57 at the base of these spaces, and the fingers 57, themselves, overlie the short needles 29 and 30. Again, the shelf 52 is capable of being shoved downwardly when in this position so that the short needles also extend above the upper surface of the shelf. Again, the purpose for this will be apparent hereinafter. It will be understood that in FIGS. 2A and 2B, the shelf 52 is shown in its normal position, with the opening 56 more or less centered over the needle block assembly 8.

Figure 10:
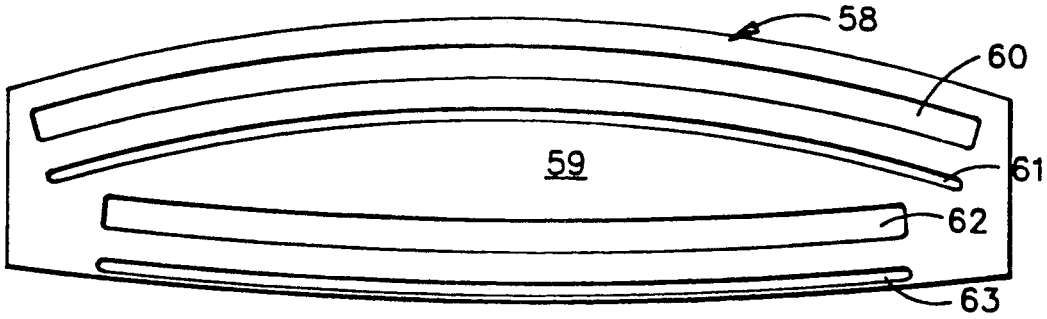
FIG. 10 is a bottom view of the press.

The device of the present invention is provided with a press which overlies the needle block assembly 8, regardless of the position of the needle block assembly In FIGS. 3 and 7, the press is generally indicated at 58 and is fragmentarily shown in its retracted position wherein full access to the needle block assembly may be attained. In FIG. 9, the press 58 is shown in a depressed position over the needle block assembly 8. The press 58 is similar to the head of a conventional clothes pressing machine, although smaller in size. FIG. 10 is a bottom view of the press. The press is connected to a source of steam (not shown) and may be provided with a steam chamber, as is known in the art. The bottom surface of the press is provided with a layer of resilient material 59. The resilient material 59 is provided with slots 60 through 63 to accommodate the needles of the needle block assembly. The slots 60–63 may also be connected to the steam chamber (not shown) of the press. It will be understood by one skilled in the art that the slots 60-63 could be replaced by appropriately arranged and sized holes or the like.

When the needle block assembly 8 is in the condition shown in FIGS. 8B and 11A, the slots 60 and 61 will accommodate short needles 29 and 30 and the long needles 31, as shown in FIG. 9. When the needle block assembly is in the condition shown in FIG. 13C, the short needles 29 and 30 will be accommodated by slot 62 and the long needles will be accommodated by slot 63.

The device of the present invention having been described in detail, its manner of operation may now be set forth. At the outset of a cycle all of the elements of the device 1 are in their normal, unactuated positions, as illustrated in FIGS. 1A, 1B, 2A, 2B, 3, 4 and 6. As a first step, a heat sensitive tape 64 is laid along the needle block assembly 8 between short needles 29 and short needles 30. Tape 64 is illustrated in place in FIG. 7. At this point, the needle block assembly 8 may be subjected to vacuum from chamber 24 via bores 25. The vacuum will help maintain tape 64 in position. Thereafter, the air cylinder 20 is actuated to cause rear pusher die 14 to shift toward the front of the device (or the right, as viewed in FIG. 1A). The arcuate leading edge 14A of rear pusher die 14 will cause the needle block assembly 8 to assume the position shown in FIG. 8B. This having been accomplished, the shelf 52 is advanced rearwardly of the device 1 by the shelf actuating cylinder (not shown) until the ends of fingers 56 extend just between the long needles 31, with the uppermost ends of long needles 31 extending above shelf 52. The shelf 52, itself, extends above the points 29*a* and 30*a* of short needles 29 and 30.

At this point, the coat back 65 is spread upon the shelf and so arranged thereon that its concave edge 66 (which will form a part of the shoulder seam) is abutting those portions of long needles 31 which extend above shelf 52. This is shown in FIG. 8A. With the coat back 65 properly located on shelf 52 the press 58 is lowered. As the press 58 descends, it causes the fingers 56 of shelf 52 to pass down between adjacent pairs of short needles 29 and 30. At the same time, the points 29*a* and 30*a* of short needles 29 and 30 penetrate the fabric of coat back 65. At this stage, the shelf 52 will be caused to shift forwardly of the device 1 until its fingers 56 slip out from under the press 58. Final downward movement of press 58 will cause the fabric of the coat back 65 to abut the top surfaces of the needle blocks. Once the coat back 65 has been firmly engaged on the short needles 29 and 30, the press 58 is lifted to its normal, open position. The somewhat bulbous points 30*a* of short needles 30 will preclude the coat back 65 from lifting off the short needles 29 and 30.

Figure 11B:
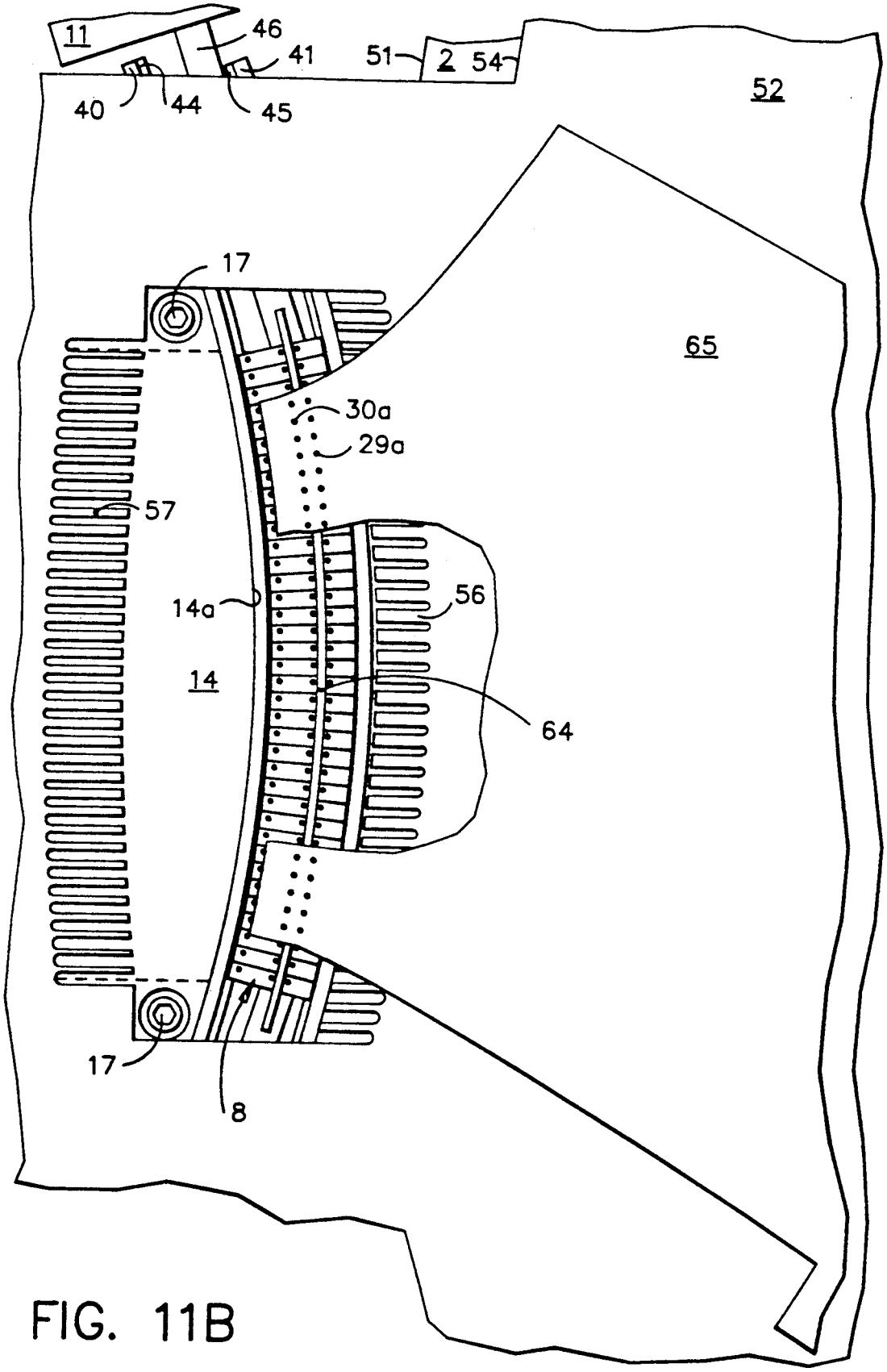
FIG. 11B is a fragmentary plan view illustrating the needle blocks and the adjacent edge of the coat back in condensed condition.

Since the concave coat back edge 66 is somewhat longer than the corresponding convex coat front edge (to be described hereinafter) it is necessary to condense the coat back edge 66 so that its length will be shortened. This is accomplished by actuating condensing cylinder 11 so that the needle block assembly changes from the configuration shown in FIG. 8B to the configuration illustrated in FIG. 11A. The condensed or shortened back edge 66, engaged by the short pins 29 and 30 and overlying the heat sensitive tape 64 is illustrated in FIG. 11B. At this point, the press is again lowered, applying pressure to the coat back edge 66 and the tape 64. The coat back edge 66 and the tape 64 are subjected to steam from the steam chamber of press 58. The steam is drawn through the coat back edge 66 and tape 64 by the vacuum drawn in chamber 24. The steam activates the heat sensitive tape 64 which is bonded to the coat back edge 66, maintaining it in its condensed condition. Once this has been accomplished, the steam is turned off and the head is raised to its normal, uppermost position.

The coat back 65 having been mounted on the needle block assembly 8, the device 1 is now ready to receive the coat front 67. As is shown in FIG. 12A and 12B, that edge 68 of the coat front 67 which will constitute a part of the shoulder seam is concave. As a result, the pusher die assembly 12 is shifted toward the rear of device 1. The concave edge 13*a* of front pusher die 13 contacts the needle block assembly 8 and causes it to assume a concave configuration as illustrated in FIG. 12C. Thereafter, the shelf 52 is shifted toward the front of device 1. As is most clearly shown in FIG. 12B, the shelf 52 assumes a position wherein its fingers 57 extend between the long needles 31 of needle block assembly 8, with the long needles located at the ends of the slots between shelf fingers 57. The remainder of fingers 57 extend at a level above the top of the points of short needles 29 and 30. The shelf fingers 57 also extend over the condensed edge 66 of the coat back 65, previously mounted on the needle block assembly and condensed thereby so as to have a length approximating the length of the coat front edge 68. The coat front 67 is laid over the coat back 65 on shelf 52 with its convex edge 68 abutting the ends of the long needles which extend above the level of the shelf 67. Again, as they did with the coat back 65, those portions of the long needles extending above shelf 52 serve as a gauge for the location of the coat front edge 68, as shown in FIG. 13A. The edge 68 is held in place by the vacuum being drawn through the needle block assembly 8. At this point, the press is lowered causing the short needle tips 20*a* and 30*a* of short needles 20 and 30 to penetrate the fabric of the coat front adjacent the coat front edge 68 in much the same manner described with respect to FIG. 9. As the press descends and engages the coat front material on the small needles 29 and 30, the shelf shifts rearwardly of the device so that the shelf fingers 57 slip out from under the coat front edge 68. Steam is then applied through the press and the fabric of the coat back 65 and coat front 67 being drawn therethrough by the vacuum within chamber 24. Thus, the steam is drawn through perforations 25 in the upper base portion 7 and the base 2 and is withdrawn from chamber 24 by the vacuum source.

Thereafter, the press is withdrawn to its normal, unactuated position and the pusher die assembly 12 is shifted toward the front of device 1 by cylinder 20 until it reaches its normal, unactuated position shown in FIGS. 1A and 1B. This enables the needle block assembly 8 to assume its normal configuration as shown in FIGS. 1A and 1B, with the corresponding edges of the coat back 65 and the coat front 67 mounted thereon. With the needle block assembly 8 in its normal position as shown in FIGS. 1A and 1B, a comb-like device with long, thin teeth (not shown) is caused to penetrate the fabric of the coat front 67 and the coat back 65 along and adjacent to the spring steel strip 41. At this point, the vacuum at chamber 24 is shut off and the chamber is connected to a source of air under pressure which passes up through bores 25 to the needle block assembly 8. Between the compressed air and the comb, the condensed edge 66 of coat back 65 and the edge 68 of coat front 67 are lifted off the needle block assembly while being maintained in their proper positions with respect to each other. By means of the comb, these edge portions 66 and 68 are transferred to a sewing machine wherein they are sewn together to form a shoulder seam of the coat.

There are numerous seam forming operations and the like which involve rectilinear fabric edges rather than concave or convex edges. While seam preparation for fabric pieces having rectilinear edges can be performed on the device just described, a considerably simplified version of the device can be advantageously used. Such a simplified version of the device of the present invention is generally indicated at 70 in FIG. 13. The device comprises a needle block holder 71 mounted on a base 72. The base 72, itself, will be provided with appropriate mounting means (not shown).

The needle block holder 71 comprises an elongated member with planar sides 73 and 74 and a planar bottom 75. The upper ends of the sides 73 and 74 curve upwardly and inwardly as at 73*a* and 74*a*. The needle block holder is provided with a longitudinal slot 75 of rectangular configuration. The slot 75 extends the length of the needle block holder and its sides are provided with grooves 76 and 77 which also extend the length of the needle block holder.

Figure 14:
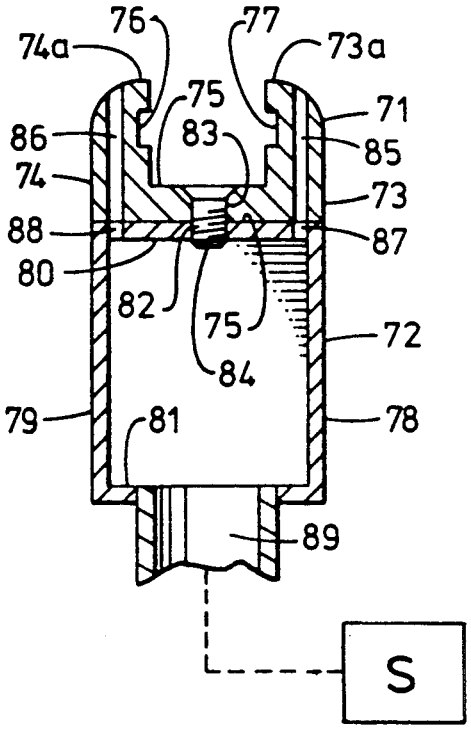
FIG. 14 is a cross-sectional view of the needle block holder of FIG. 13.

The base 72 constitutes an elongated hollow member having a length equivalent to the length of the needle block holder 71. The base 72 has a pair of planar sides 78 and 79, a planar top 80 and a planar bottom 81. The top 80 is provided with a plurality of threaded perforations, one of which is shown at 82. The bottom of the needle block holder is provided with corresponding unthreaded perforations, each provided with a countersink. Flat head machine screws, one of which is shown at 84, attach the needle block holder 71 to the base 72, as shown in FIG. 14.

The base and needle holder structure is completed by the provision of a row of vertical perforations 85 in the side wall 73 of needle block holder 71 and a similar row of vertical perforations 86 in its other side wall 74. The top 80 of base 72 is provided with a first row of perforations 87 coaxial with the needle block holder perforations 85, and a second set or row of perforations 88, coaxial with the row of perforations 86 in the needle block holder. The base 72 is provided with a central conduit 89 connected to a vacuum source (S). It will be apparent that when that when the vacuum source is turned on, a vacuum will be drawn through needle block holder perforations 85 and 86 and the base perforations 87 and 88. The purpose of the vacuum will be apparent hereinafter.

Figure 15:
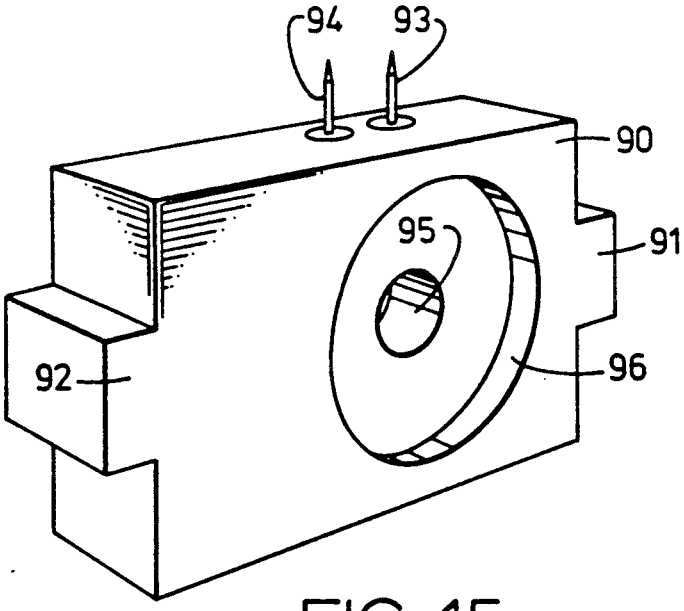
FIG. 15 is a perspective view of a needle block of the embodiment of FIG. 13.

An exemplary needle block 90 is illustrated in FIG. 15. Needle block 90 comprises a rectangular block slidably mountable in the longitudinal slot 75 of needle block holder. The needle block 90 has a pair of laterally extending lugs 91 and 92 receivable within the needle block holder grooves 77 and 76, maintaining the needle block 90 within the needle block holder slot 75. Needle block 90 is provided with a pair of fabric engaging pins 93 and 94 equivalent to the needle block pins 29 and 30 of FIG. 5B. If desired, the needles 93 and 94 may be given a bulbous tip of the type illustrated at 30*a* in FIG. 5B.

Needle block 90 is provided with a transverse perforation 95 (equivalent to perforation 32 of FIG. 5B) and a circular depression 96, equivalent to the circular depression 33 of FIG. 5B. The depression 96 is adapted to receive a resilient O-ring equivalent to O-rings 34 of FIG. 6.

A plurality of needle blocks identical to needle block 90 are mounted in the slot 75 of needle block holder 71 in side-by-side relationship. The needle blocks 90 are spaced from each other by the O-rings (not shown).

A generally U-shaped bracket 97 is mounted on one end of the needle block holder-base assembly. The bracket 97 has a base portion 97*a* and a pair of upstanding legs 97*b* and 97*c*. A condensing cylinder 98 is mounted on bracket leg 97*c*. The condensing cylinder 98 may be hydraulically powered or air powered. Condensing cylinder 98 is provided with a tubular member 99 which extends through a perforation (not shown) in bracket leg 97*c* and through a notch 100 in bracket leg 97*b*. The condensing cylinder 98 is provided with a piston (not shown) to which a cable (not shown) is affixed. The cable is equivalent to cable 48 of FIG. 6 and passes through the cylinder tubular member 99 and the perforations 95 in each of the needle blocks. Having passed through the endmost needle block, the cable will be provided with an adjustable termination member (not shown) equivalent to cable termination 49 of FIG. 6.

The cylinder tubular member 99 normally abuts the first needle block 90. The cable is of such length that when the piston is in its normal, unactuated position, the needle blocks will be in their normal positions, spaced from each other by the O-rings.

When the piston of condensing cylinder 98 is shifted to its actuated position (i.e., to the left as viewed in FIG. 13) the cable will cause the needle blocks 90 to shift to their condensed positions, against the action of the resilient O-rings.

Figure 16:
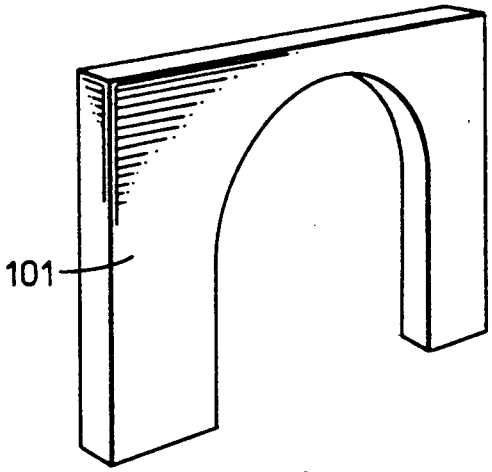
FIG. 16 is a perspective view of a spacer for use with the embodiment of FIG. 13.

As indicated above, it is sometimes desirable that the condensing action be greater at the center of the row of needle blocks than at the ends of the row. To achieve this, it is within the scope of the invention to provide spacer blocks between the needle blocks, particularly at the ends of the row thereof. An exemplary spacer block is illustrated in FIG. 16. It comprises a rectangular block 101 somewhat thinner than the needle block 90 and provided with a notch 102 shaped and sized to accommodate the O-ring of the adjacent needle block. Spacer block 101 need not be provided with lugs equivalent to the needle block lugs 91 and 92.

The assembly thus far described may be provided with a pair of ribbon-type heating elements affixed to and extending along the sides 78 and 79 of base 72. One such heating element is illustrated at 103 in FIG. 13.

Figure 13:
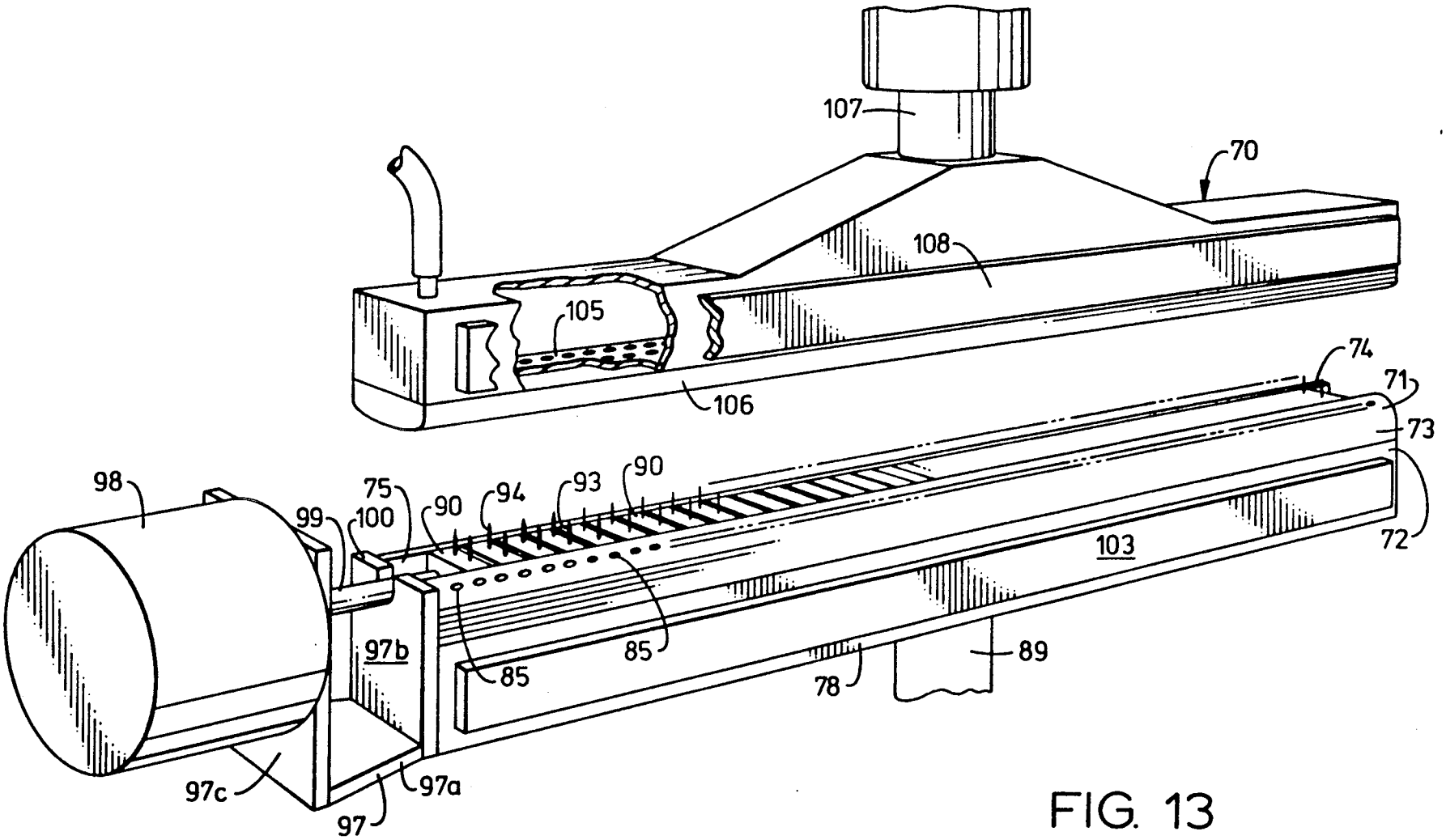
FIG. 13 is a fragmentary perspective view of a simplified version of the device of the present invention.

The simplified structure of FIG. 13 is provided with a press, generally indicated at 104. The press 104 comprises a hollow elongated member of a length substantially equivalent to the length of the needle block holder 71 and the base 72. The bottom 105 of the press is foraminous, as shown in FIG. 13. A porous pad 106 is affixed to the bottom 105. The pad 106 may be made of fabric, rubber, fabric covered rubber, or the like. The press 104 is provided with an inlet 107 connected to a source of steam. Again, a pair of ribbon-type heating elements may be attached to the longitudinal sides of press 104. One such heating element is illustrated at 108. These heating elements reduce condensation of the steam from inlet 107.

It will be understood that the press 104 will be mounted in such a way that it can be shifted vertically between a retracted position shown in FIG. 13 and an extended position wherein it engages the needle blocks 90, the pad 106 accommodating the needles 93 and 94. Vertical shifting of press 104 is accomplished by cylinder 107*a*. The piston and rod 107*b* of cylinder 107*a* is affixed to the press 104.

An exemplary operation utilizing the simplified embodiment of FIG. 13 involves the preparation of the seam between the top sleeve and the under sleeve of a suit coat. The seam in this instance is made between rectilinear edges of the fabric pieces. However, the undersleeve fabric edge requires condensing. To this end, a piece of fusible tape, equivalent to the tape 64 of FIG. 7 is laid longitudinally along the needle blocks between needles 93 and 94. Thereafter, the edge of the undersleeve is engaged on the needles. The press is then lowered to fully seat the undersleeve on the needle blocks. The press is thereafter retracted and the condensing cylinder is actuated to condense the edge of the undersleeve. The undersleeve is held in its condensed condition by the condensing cylinder. Thereafter, the edge of the top sleeve is engaged on the needles 93 and 94. At this point, the press is lowered to fully seat the top sleeve edge on the needles. Thereafter, pressure is applied by the press, along with steam which is drawn through the top sleeve and the undersleeve by vacuum within base 72. The pressure and heat will cause the fusible tape to fuse against the undersleeve, maintaining the undersleeve in its condensed condition. After the pressing operation, the press is raised to its retracted position and the vacuum is continued in the base 72 to dry the fabric. Thereafter, the fabric is removed from the device and the fabric elements are sewn together.

A substantially identical operation can be performed on the structure of FIG. 13 for preparing the seam between a suit coat front and the side body. The rectilinear edge of the suit coat front will require condensing.

The device of FIG. 13 can also be used in a bridle operation. In this operation, a coat front has a layer of fusible material fused thereto. The coat front with the fusible material on it and facing down is pressed on the needles 93 and 94 along a line approximately ¼ inch away from the lapel. The head 104 is lowered to fully seat the material on the pins. The head is then retracted and the condensing cylinder 98 is actuated to condense the bridle area. A piece of fusible tape is laid one-half on the chest piece and one-half on the coat front. The head 104 is again lowered and applies pressure and steam to the material to fuse the tape to the material. Vacuum is applied to the base 72 to draw the steam through the material. The head is then raised and the vacuum is continued to dry the material. Thereafter, the material may be removed from the device and sewn together.

Figure 17:
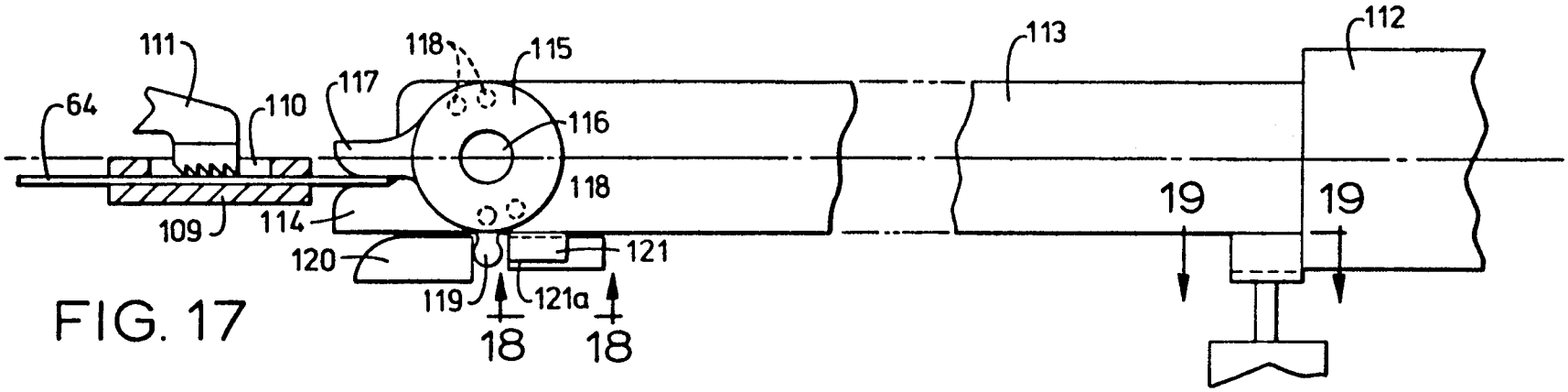
FIG. 17 is a fragmentary side elevational view of a tape dispensing device of the present invention, shown in its extended tape engaging position.

As indicated above, the condensing and alignment devices of the present invention may be operated manually, or they may be operated automatically by computer means. When it is desired to make to device fully automatic, it is preferable that means be provided to automatically dispense the fusible tape 64 between the needles 29 and 30 (see FIG. 7). An exemplary tape dispenser is illustrated in FIGS. 17–21. The tape dispenser comprises a supply or roll of tape (not shown) mounted on one side of the base 5 of the device 1 of FIG. 1A. From the roll, the tape is caused to pass through a slotted element 109 having an elongated opening 110 in its upper surface. A dog 111 is used to shift the tape in the element 109 so that a short end thereof will extend beyond the element 109 as indicated in FIG. 17. The actuating mechanism for dog 111 can be of any well-known and conventional type. The dispenser also comprises a cylinder 112 mounted on the opposite side of the base 5 of the device 1 of FIG. 1A. The cylinder 112 has a piston rod which is shiftable by the cylinder between an extended position shown in FIG. 17 and a fully retracted position shown in FIG. 21. At the beginning of the operation, when the needle block assembly 8 is in its normal, rectilinear configuration, the piston rod 113 will be actuated by cylinder 112 to shift across the needle block assembly 8 between the needles 29 and 30. At its forwardmost end, the piston rod 113 has a lower jaw 114 formed thereon. A rotatable disc 115 is pivotally mounted by pivot pin 116 to the piston rod 113. The disc 115 has a radially extending jaw 117, adapted to cooperate with piston rod jaw 114.

When the disc jaw 117 is in its closed position, as illustrated in FIG. 17, the piston rod 113 and the disc 115 each has four circular depressions which are in alignment. The aligned depressions are indicated in broken lines at 118. The depressions in the piston rod 113 carry spring loaded ball bearings. When the jaw 17 is in its closed position, these ball bearings also extend into the depressions in the disc 115. This arrangement releasably locks the disc 115 in its rotative position wherein the jaw 117 is closed with respect to the jaw 114.

Figure 21:
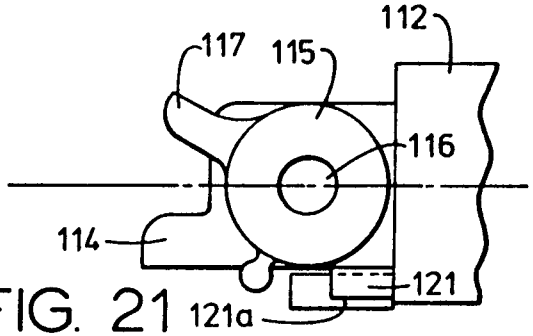
FIG. 21 is a fragmentary side elevational view of the tape dispenser with its tape-engaging jaw in open position.
Figure 18:
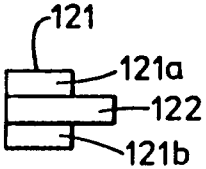
FIG. 18 is a bottom view along line 18—18 of FIG. 17.

At the outset, the piston rod 113 is fully retracted as illustrated in FIG. 21, with the jaw 117 in its open position. At the beginning of a cycle, the piston rod shifts to its extended position across the needle block assembly (not shown) and between the needles 29 and 30 thereof. When the piston rod 113 reaches its fully extended position, the piston rod jaw 114 passes beneath the free end of tape 114. The disc 115 has a lug 119 formed thereon. At the forwardmost end of the piston rod travel, the lug 119 abuts a stop 120, causing the disc 115 to rotate in a counter-clockwise direction. This shifts the disc jaw 117 to its closed and locked position and the free end of tape 64 is engaged between the tape dispenser jaws 114 and 117. Near the disc 115, the piston rod 113 carries a bifurcated lug 121. The bifurcated lug has a pair of bifurcations **121*a* and 121*b*. A slide 122 is captively and shiftably mounted between bifurcations 121*a* and 121*b*. The purpose of lug 121 and slide 122** will be apparent hereinafter.

The tape dispenser structure is completed by the provision of a stop lug 123. As is most clearly shown in FIG. 19, the stop lug has a longitudinal slot 124 formed therein. The stop lug 123 is mounted on the core of a solenoid 125. The stop lug 123 is shiftable by solenoid 125 between an extended position shown in solid lines in FIGS. 17 and 20, and a retracted position shown in broken lines in FIG. 20.

Figure 20:
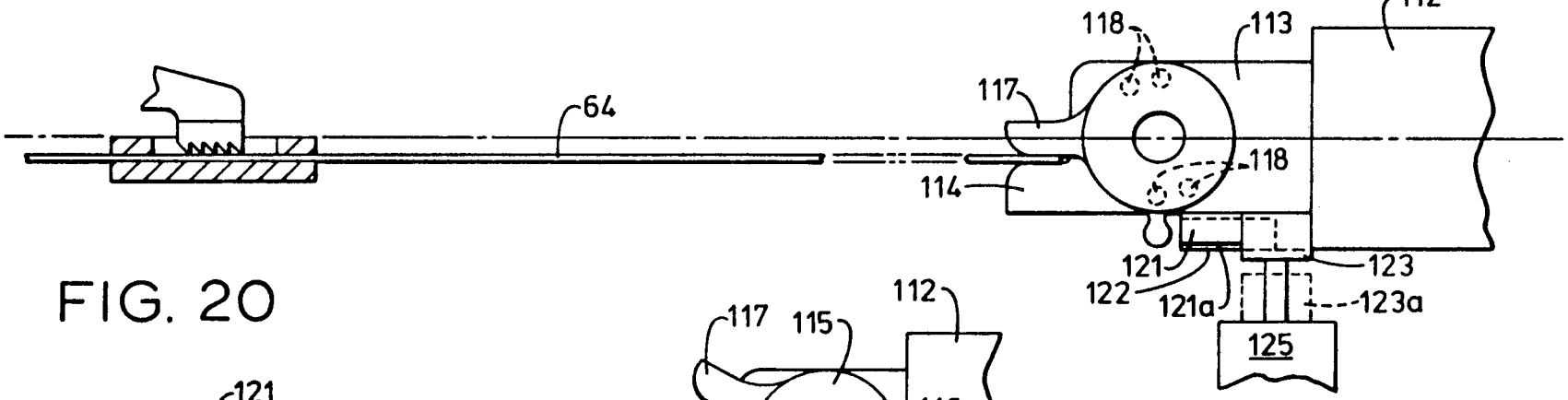
FIG. 20 is a fragmentary side elevational view of the tape dispenser in its tape-dispensed position.
Figure 19:
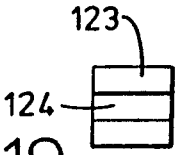
FIG. 19 is a plan view along line 19—19 of FIG. 17.

When the piston rod 113 is shifted to its retracted position, stop lug 123 will be in its extended position, as shown in FIG. 20. The piston rod will shift to the right as viewed in FIG. 20, pulling the tape 64 across the needle blocks between the needles 29 and 30. Since the stop lug temporarily stops piston rod 113 from achieving its fully retracted position, the jaws 114 and 117 will remain closed and clamped on the tape. At the end of a cycle, the solenoid 125 will shift the stop 123 downwardly to its position shown in broken lines in FIG. 20 at **123*a*. This enables the piston rod to shift to its fully retracted position. At the same time, the slide 122 engages the face of the piston and is shifted away therefrom. This causes the slide to engage the lug 119 of disc 115, rotating the disc in a clockwise direction (as viewed in the FIGS.), out of engagement with the ball bearings 118 and to a position wherein jaw 117** is open, releasing the tape. At this point, trimming means (not shown) will trim the ends of the tape, severing it from the roll thereof.

It will be obvious from the description above that the tape dispensing assembly not only dispenses tape between the needles 29 and 30 of the needle blocks, but also maintains the tape under a slight pulling force throughout the cycle of the device. This will assure that the tape will be in proper position when fused to the condensed edge of the coat back. It will be understood that the tape dispensing device of FIGS. 17–21 could be employed with the device 70 of FIG. 13.

Figure 22:
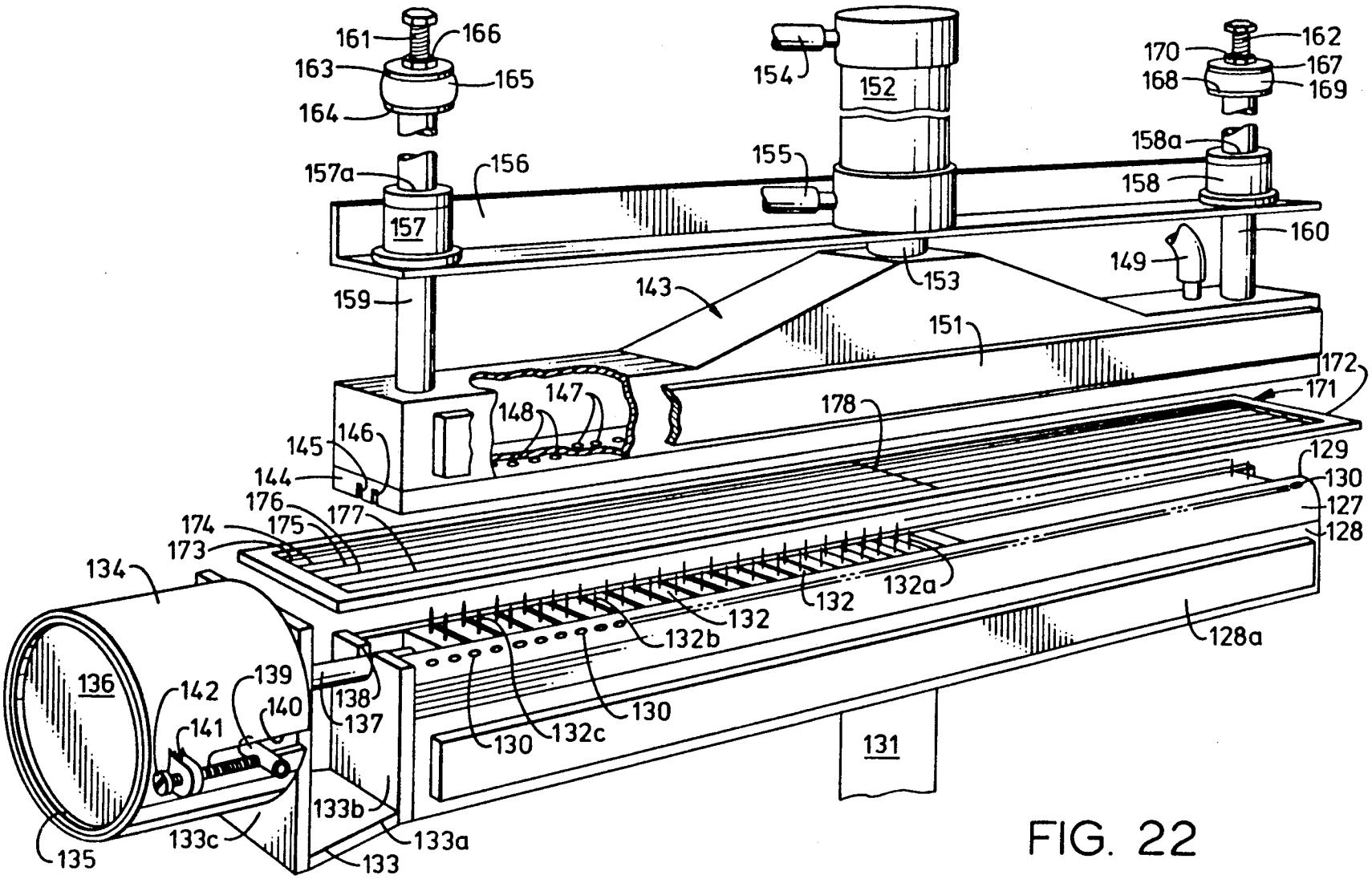
FIG. 22 is a fragmentary perspective view of another simplified version of the device of the present invention.
Figure 23:
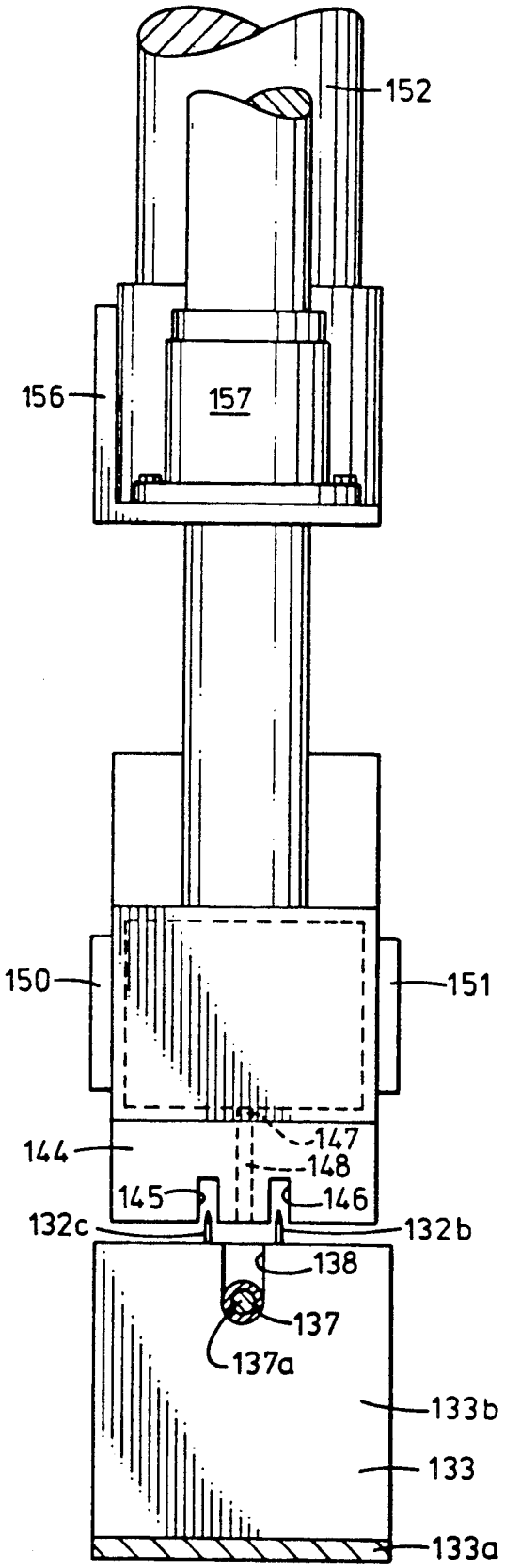
FIG. 23 is a fragmentary end elevational view, partly in cross-section, of the device of FIG. 22.
Figure 24:
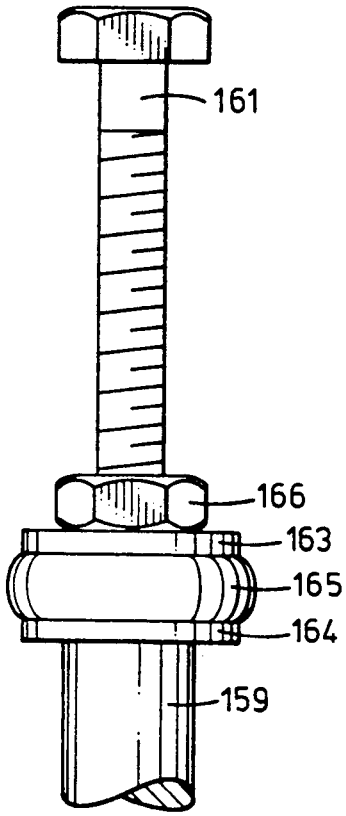
FIG. 24 is a fragmentary elevational view of the upper end of one of the guide rods of FIG. 22.

FIGS. 22–24 illustrate another simplified embodiment of the present invention. In FIG. 22, this embodiment is generally indicated at 126. The device comprises a needle block holder 127 similar to needle block holder 71 of FIG. 13. Again, the needle block holder is mounted on a base 128 provided with appropriate mounting means (not shown).

The needle block holder 127 is provided with an elongated slot 129 equivalent to the elongated slot 75 of FIGS. 13 and 14. The slot 129 extends the length of the needle block holder and its sides are provided with grooves (not shown) equivalent to the grooves 76 and 77 of FIG. 14.

The base 128 is identical to the base 72 of FIGS. 13 and 14 and is provided with a ribbon-type heating element on both sides, one of which is shown at 128*a*. The needle block holder 127 may be affixed to base 128 in the same manner described with respect to FIG. 14. The needle block holder 127 is provided with a row of vertical perforations to either side of longitudinal slot 129. One such row is illustrated in FIG. 22 at 130. The top of the base 128 to which the needle block holder 127 is affixed is provided with corresponding perforations not shown The base 128 has a conduit 131 connecting it to a source of vacuum (not shown). Thus, when the vacuum source is turned on, a vacuum will be drawn through the needle block holder perforations 130 and the corresponding perforations in the needle block holder on the other side of slot 129.

The needle blocks 132 are slidably mounted in needle block holder slot 129. The needle blocks 132 may be identical to needle block 90 illustrated in FIG. 15. The needle blocks 132 will be provided with laterally extending lugs equivalent to lugs 91 and 92 of FIG. 15 which will ride in the grooves in the sides of longitudinal slot 129. The only difference between the arrangement of FIG. 22 and the similar arrangement of the embodiment of FIG. 13 lies in the fact that the centermost needle block 132*a* of the row thereof is fixed within the longitudinal slot 129, all of the other needle blocks 132 being slidable therein. Each of the needle blocks 132 and the centermost needle block 132*a* is provided with a circular depression equivalent to the depression 96 of FIG. 15 and a perforation equivalent to the perforation 95 of FIG. 15 for the passage of a cable therethrough.

One end of the needle block holder-base assembly is provided with a generally U-shaped bracket 133. The bracket 133 is identical to bracket 97 of FIG. 13, having a base 133*a* and a pair of upstanding legs 133*b* and 133*c*. The upstanding leg 133*b* is attached to the needle block holder-base assembly, as shown in FIG. 22.

A difference between the embodiment of FIG. 22 and the embodiment of FIG. 13 lies in the fact that the upstanding leg 133*c* of the U-shaped bracket 133 has a cylindrical member 134 welded thereto. The inside surface of cylindrical member 134 is provided with a Teflon* lining 135 or the like. A condensing cylinder 136 is mounted within the cylindrical member 134. The condensing cylinder 136 may be hydraulically powered or air powered, and is provided with a tubular member 137 which extends from its forward face through a perforation (not shown) in bracket leg 133*c* and through a notch 138 in bracket leg 133*b*.

The condensing cylinder 136 is substantially identical to condensing cylinder 98 of FIG. 13 and is provided with a piston (not shown) to which a cable (not shown) is affixed. The cable is equivalent to cable 48 of FIG. 6 and passes through the cylinder tubular member 137 and the above-mentioned perforations in each of the needle blocks Having passed through the endmost needle block, the cable is provided with an adjustable termination member (not shown) equivalent to cable termination 49 of FIG. 6.

The mounting of condensing cylinder 136 within the cylindrical member 134 enables the condensing cylinder to shift axially toward and away from the upstanding bracket leg 133*c*. The cylinder tubular member 137 normally abuts the first of the needle blocks 132, as shown in FIG. 22. The cable (not shown) is of such length that when the piston is in its normal, unactuated position, the needle blocks 132 will be in their normal positions, spaced from each other by the O-rings they carry.

When the piston of condensing cylinder 136 is shifted to its actuated position (i.e., to the left, as viewed in FIG. 22), the cable will cause the needle blocks to shift to their condensed positions against the action of the resilient O-rings. Since the centermost needle block 132*a* is fixed within slot 129, when the piston of the condensing cylinder 136 is shifted to its actuated position, the cable termination will cause those needle blocks located to the right of needle block 132*a* (as viewed in FIG. 22) to shift to the left, toward needle block 132*a*. At the same time, the condensing cylinder 136 will shift to the right (as viewed in FIG. 22) within cylindrical member 134 and its tubular member 137 will cause those needle blocks 132 located to the left (as viewed in FIG. 22) of fixed needle block 132*a* to shift to the right, toward the fixed needle block 132*a*. As a consequence, needle blocks 132 of the embodiment of FIG. 22 shift in the same manner described with respect to the needle blocks of FIG. 4, and the resulting condensing of fabric engaged by the needles of the needle blocks will be symmetrical. Thus, if the fabric parts to be condensed come in "lefts" and "rights," both can be condensed on the embodiment of FIG. 22. This is not true of the embodiment of FIG. 13, wherein all of the needle blocks 90 shift toward the fixed condensing cylinder 98.

It is sometimes desirable that the condensing action be greater at the center (for example) of the row of needle blocks 132, than at the ends of the row. As in the case of the previously described embodiments, this is achieved by the provision of spacer blocks between the needle blocks, particularly at the ends of the row thereof. For this purpose, spacer blocks of the type illustrated in FIG. 16 at 101 can be used.

The condensing cylinder 136 may be of the double-acting or single-acting type and may be actuated by compressed air or hydraulic fluid. For purposes of an exemplary showing, the condensing cylinder 136 is illustrated as being of the single-acting type provided with a port 139 for compressed air near its forward end. The piston (not shown) of the condensing cylinder 136 is shifted to its actuated position by the introduction of compressed air through port 139. When the port 139 is vented to atmosphere, a spring located within the cylinder returns the piston to its normal, unactuated position. Since the condensing cylinder 136 is axially shiftable within the cylindrical member 134, the cylindrical member 134 is provided with a longitudinally extending slot 140 to accommodate the port 139.

At the beginning of a condensing cycle, when compressed air is introduced into condensing cylinder 136, shifting its piston to the left as viewed in FIG. 22, the condensing cylinder, itself, will be shifted to the right (as viewed in FIG. 22) within cylindrical member 134. At the end of a cycle when the compressed air within the condensing cylinder 136 is vented to atmosphere, the cylinder spring (not shown) will shift the piston to the right as viewed in FIGS. 22. At the same time, the condensing cylinder 136 will shift axially in cylindrical member 134 to its normal, unactuated position. It is desirable that this normal, unactuated position of the condensing cylinder 136 within the cylindrical member 134 is the same at the outset of each cycle and is adjustable. To this end, the cylindrical member 134 may be provided with a lug 141 adjacent the closed end of slot 140. The lug 141 has a threaded perforation extending therethrough for the receipt of an adjustment screw 142. The screw 142 may be adjusted axially with respect to the lug 141 and determines the normal, unactuated axial position of condensing cylinder 136 by abutting port 139.

The embodiment of FIG. 22 is provided with a press, generally indicated at 143. The press 143 is similar to the press 104 of FIG. 13, comprising a hollow elongated member of a length substantially equivalent to the length of the needle block holder 127 and the base 128. Affixed to the bottom of the press 143 is an elongated block 144 of substantially the same width and length. The block 144 is provided with a pair of longitudinally extending grooves 145 and 146 adapted to accommodate the needles **132*b* and 132*c* of needle blocks 132. The press 143 has a single, central, longitudinally extending row of perforations 147 formed in its bottom. The block 144 has a single, longitudinally extending row of perforations 148, coaxial with the perforations 147, and extending the length of the block between the grooves 145 and 146. The coaxial perforations 147 and 148 permit the passage of steam from the press 143 The press 143 has a steam inlet illustrated at 149 in FIG. 22. To minimize condensation of the steam located within the press 143, the sides of the press may be provided with ribbon-type heaters 150 and 151**.

The press 143 is mounted in such a way that it can be shifted vertically between a retracted position shown in FIG. 22 and an extended position wherein it engages the needle blocks 132. Vertical shifting of the press 143 is accomplished by a cylinder 152 having a piston rod 153 affixed to the press 143. For purposes of an exemplary showing, the cylinder 152 is illustrated as being of the double-acting type, provided with ports 154 and 155 near its ends. The ports 154 and 155 are provided with conventional valve means (not shown) whereby each of the ports can be independently connected either to a source of air under pressure (not shown) to atmosphere. The cylinder 152 is provided with appropriate support means (not shown).

An elongated angle iron support 156 is affixed to cylinder 152. The piston rod 153 passes through a perforation (not shown) in support 156. Support 156 is in parallel spaced relationship to needle block holder 127 and base 128. Near its ends, the support 156 has a pair of cylindrical guides 157 and 158 mounted thereon. The guides 157 and 158 have axial bores **157*a* and 158*a*, respectively. Support 156 is provided with perforations (not shown) coaxial with the bores 157*a* and 158*a*. Slidably mounted within the bores 157*a* and 158*a* of guides 157 and 158 is a pair of guide rods 159 and 160. The lower end of guide rods 159 and 160 are affixed to the upper surface of press 143 near its ends, as is clearly shown in FIG. 22. The uppermost ends of guide rods 159 and 160 are provided with an axial threaded bore (not shown) in which bolts 161 and 162** are threadedly engaged.

FIG. 24 illustrates the upper end of guide rod 159, with its bolt 161. It will be noted that the bolt 61 passes through an assembly of a pair of metallic washers 163 and 164, with a thick washer 165 of resilient material located therebetween. The bolt 161 also carries a nut 166. By adjusting the position of nut 166 on bolt 161, the amount of compression of the resilient washer 165 can be adjusted. The purpose of this structure will be apparent hereinafter.

As is shown in FIG. 22, the bolt 162 of guide rod 160 passes through an identical assembly comprising a pair of metallic washers 167 and 168 with a thick resilient washer 169 therebetween. The bolt 162 carries an adjustment nut 170, equivalent to the nut 166 of bolt 161.

As will be apparent to one skilled in the art, when the port 155 of cylinder 152 is connected to atmosphere and the port 154 is connected to a source of compressed air, the cylinder 152 and piston rod 153 will cause the press 143 to shift downwardly to its lowermost position abutting needle blocks 132 and applying pressure thereto. When port 155 of cylinder 152 is connected to compressed air, and the port 154 is connected to atmosphere, the cylinder 152 and piston rod 153 will cause the press to shift upwardly to its retracted position shown in FIG. 22. The press 143 will remain in its retracted position so long as port 155 is connected to a source of compressed air. Guide rods 159 and 160 will maintain the press 143 in its proper orientation with respect to needle block holder 127.

When both ports 154 and 155 of cylinder 152 are connected to atmosphere, the press 143 will shift downwardly under its own weight. The press 143 will shift downwardly until it abuts needle blocks 132, compressing the resilient washers 165 and 169. Once the press 143 has bottomed on the needle blocks 132, the resilient washers 165 and 169 will recover and cause the press to move upwardly to an intermediate position wherein it is spaced from the needle blocks 132 by a distance such that the uppermost ends of the needles **132*b* and 132*c* will remain in the slots 145 and 146. This intermediate position of the press 143 is illustrated in FIG. 23. It will be understood that this intermediate position of the press 143 is determined by proper adjustment of nuts 166 and 170**.

The structure of FIG. 22 may be provided with a screen member, if desired, the screen member is generally indicated at 171 and comprises an elongated rectangular frame 172. The frame 172 may be slightly longer than the needle block holder 127. The frame 172 supports a series of wires 173 through 177 extending parallel to the rows of needles **132*a* and 132*b*. The wires are additionally supported at their longitudinal center by a transverse wire 178 mounted on the frame 172**.

The frame 172 is provided with appropriate support means by which it is shiftable between a raised position as shown in FIG. 22 and a lowered position wherein the wires 173–177 lie against the upper surfaces of the needle blocks 132. The wires 173 and 174 are so positioned that they will lie just outside the row of needles **132*c*. The wire 175 is so positioned that it will lie between the rows of needles 132*b* and 132*c*. Finally, the wires 176 and 177 are so positioned as to lie just outside the row of needles 132*b*. The transverse wire 178 will lie alongside the needles 132*b* and 132*c* of fixed needle block 132*a*. The purpose of screen member 171 is to assist in removing the fabric layers from the needles 132*b* and 132*c*** at the end of a condensing cycle, as will be apparent hereinafter. It will be understood that the embodiment of FIG. 13 could be provided with a screen member identical to screen member 171, for the very same purpose.

The embodiment of FIGS. 22, 23 and 24 has numerous applications. An exemplary operation utilizing this embodiment involves the condensing of the bridle portion of a suit coat. At the beginning of the operation, port 155 of cylinder 152 will be connected to the source of compressed air and the port 154 will be connected to atmosphere. Thus, press 143 will be held in its retracted position as shown in FIG. 22. The frame member 171 is shifted to its lowermost position wherein the wires 173-177 engage the upper surfaces of needle blocks 132. At this point, the coat front is arranged on the device so that rows of needles 132*b* and 132*c* extend through the coat front in the bridle area. Thereafter, the appropriate edge of the chest piece is mounted on the row of needles 132*b*. Finally, an appropriate length of fusing tape is mounted on both rows of needles 132*b* and 132*c* with one-half of the width of the fusing tape overlying the edge of the chest piece and the other half of the width of the fusing tape overlying the coat front.

This having been accomplished, the port 155 of cylinder 152 is connected to atmosphere with the result that the press 143 will fall under its own weight. The press will fully seat the coat front, the chest piece and the fusing tape on the rows of needles 132*b* and 132*c* and will then raise to its intermediate position illustrated in FIG. 23.

With the press 143 supported in its intermediate position by the resilient washers 165 and 169, the condensing cylinder 136 is actuated to condense the coat front, the chest piece and the fusing tape. Since the uppermost ends of needles 132*b* and 132*c* are located within the press slots 145 and 146, the fabric layers cannot bulge upwardly and off of the needles during the condensing operation.

The condensing operation having been accomplished, the port 155 of cylinder 152 remains connected to atmosphere and the port 154 is connected to a source of air under pressure. This causes the press 143 to shift downwardly and apply high pressure to the coat front, the chest piece and the fusing tape. A vacuum is drawn through the needle holder perforations 130, the base 128 and the conduit 131. At the same time, steam is introduced into the press 143 via conduit 149. The vacuum will draw the steam downwardly through the fusing tape, the chest piece and the coat front. The high pressure, the steam and the vacuum are maintained for an appropriate dwell time whereupon the conduit 149 is disconnected from the source of steam and the port 155 of cylinder 152 is connected to a source of compressed air, while the port 154 is connected to atmosphere. This causes the press, 143 to lift to its retracted position. Meanwhile, the vacuum is maintained to dry the fabric layers.

Once the fabric is appropriately dry, the vacuum is shut off and the frame member 171 is lifted releasing the coat front, chest piece and fusing tape assembly from the needles 132*b* and 132*c*, whereupon the condensing operation is complete.

Figure 25:
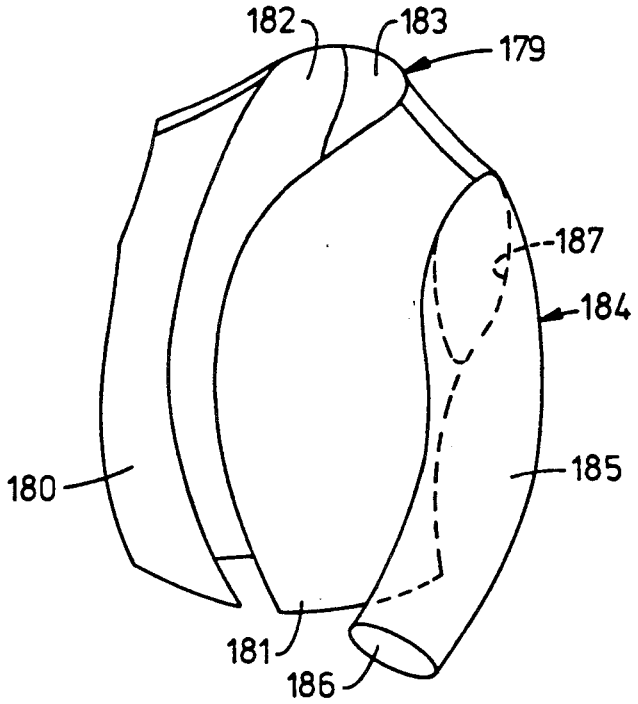
FIG. 25 is a perspective view of a partially assembled suit coat.
Figure 26:
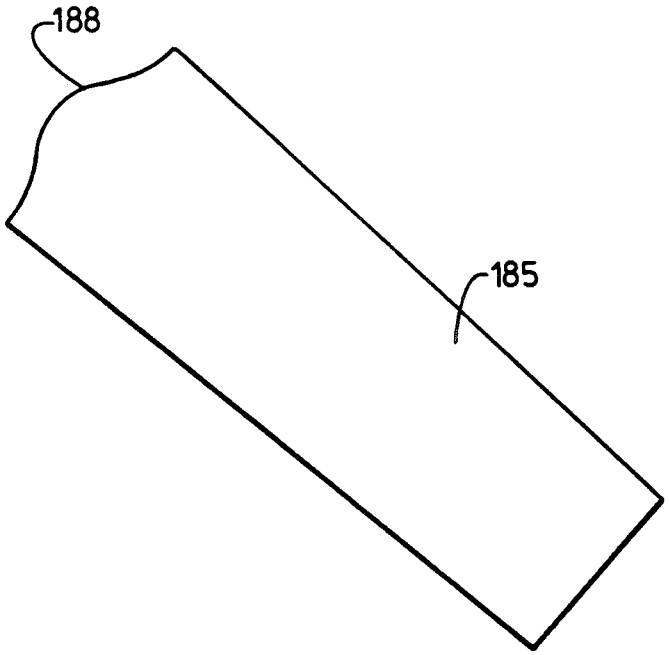
FIG. 26 is a perspective view of a top sleeve for a suit coat.

There are instances wherein simple condensing of the type described with respect to the embodiments of FIGS. 13 and 22 needs to be performed along a non-rectilinear line. An example of this is illustrated in FIGS. 25 and 26. FIG. 25 illustrates a partially constructed suit coat generally indicated at 179. The coat 179 comprises a pair of coat fronts 180 and 181 and a pair of coat backs 182 and 183. Affixed to coat front 181 and coat back 183 there is a sleeve generally indicated at 184. The sleeve 184 is made up of two parts, a top sleeve 185 and a bottom sleeve 186. The coat sleeve 184 is attached to the suit coat 179 about the shoulder opening 187 formed between coat front 181 and coat back 183.

FIG. 26 is a plan view of the top sleeve 185. It will be noted that the uppermost edge 188 of top sleeve 185 (i.e., that edge to be attached to the coat front 181 and the coat back 183) is not rectilinear.

To accomplish condensing of the top sleeve edge 188, an embodiment of the present invention may be used which has a needle block holder, base and condensing cylinder identical to those described with respect to FIG. 22 with the exception that the slot in the needle block holder is non-rectilinear. This is diagrammatically illustrated in FIG. 27 wherein the needle block holder 189 is provided with a non-rectilinear slot 190 conforming generally to the shape of the top sleeve edge 188. To this end the embodiment of FIG. 27 will be provided with a condensing cylinder 191 equivalent to condensing cylinder 136 of FIG. 22. The condensing cylinder 191 is mounted in a cylindrical member 192, equivalent to cylindrical member 134 of FIG. 22. The condensing cylinder 191 will have a tubular member 193 affixed to its forward face and equivalent to the tubular member 137 of FIG. 22. Needle block holder 189 is provided with a plurality of needle blocks 194, one of which is shown in FIG. 28. It will be noted that the needle block 194 of FIG. 28 is substantially similar to the needle block 90 of FIG. 15, having a pair of laterally extending lugs 195 and 196 adapted to be engaged in grooves in the side of needle block slot 190. Needle block 194 has a pair of upstanding needles 197 and 198, and a circular depression 199 in one of its faces adapted to receive an O-ring 200. Finally, the needle block 194 is provided with a perforation 201 adapted to accommodate the cable 202 (see FIG. 27) of the cylinder 191.

Returning to FIG. 27, the cable 202 is provided with an appropriate termination 203 at that end of the needle block slot opposite cylinder 191. As in the case of the embodiment of FIG. 22, the centermost needle block 194*a* is fixed so that condensing will be symmetrical, as described with respect to FIG. 22.

Figure 27:
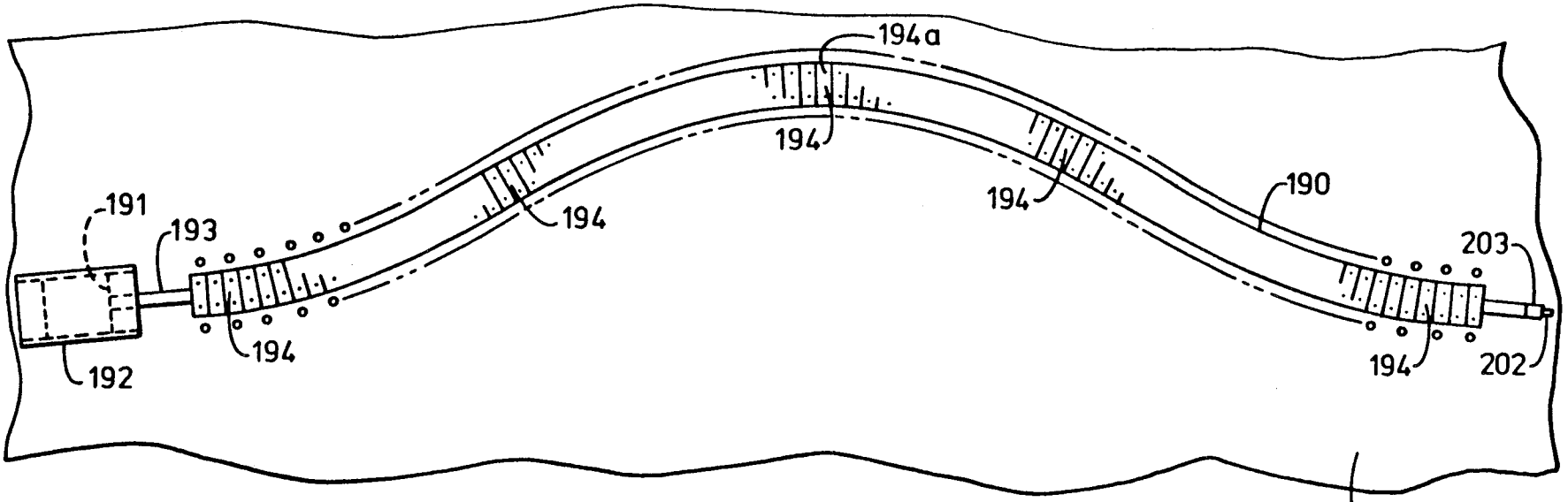
FIG. 27 is a fragmentary semi-diagrammatic plan view of another simplified version of the device of the present invention.
Figure 28:
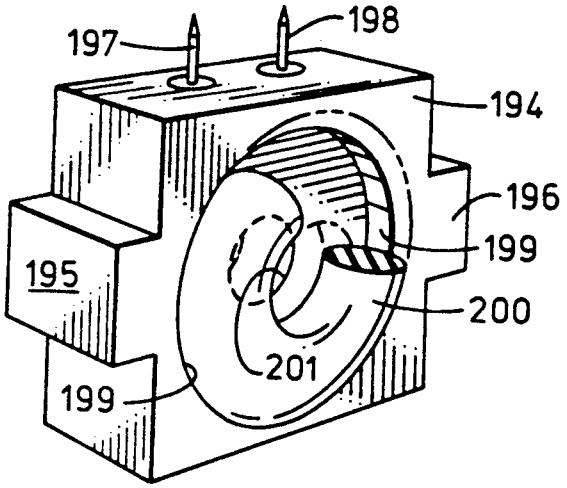
FIG. 28 is a perspective view of a needle block for use with the embodiment of FIG. 27.

The embodiment of FIG. 27 may be provided with a press (not shown) of the type shown at 104 and described with respect to FIG. 13 or of the type shown at 143 and described with respect to FIG. 22. Where a press of the type described with respect to FIG. 122 is employed, the needle receiving slots 145 and 146 of the press assembly must be of an appropriate non-rectilinear configuration to accommodate the needle block needles.

The operation of the embodiment of FIG. 27 will be substantially the same as that described with respect to the embodiments of FIGS. 13 and 22. While a fusing tape may be used, it would be difficult to lay along the non-rectilinear rows of needles. To this end, the edge 188 of sleeve top 185 may be coated with a heat reactive resin composition which will maintain the edge 188 in condensed condition, once the edge has been subjected to pressure and steam.

Figure 29:
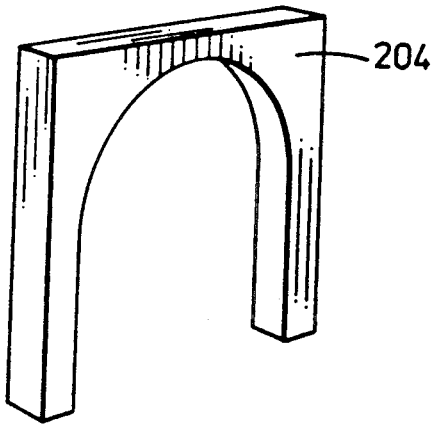
FIG. 29 is a perspective view of a spacer for use with the embodiment of FIG. 27.

The amount of condensing required along the edge 188 varies. To accomplish this, spacers may be used of the type illustrated in FIG. 29 at 204. It will be apparent that the spacer 204 is quite similar to the spacer 101 of FIG. 16 and is used in the same manner.

The shape of the upper edge 188 of the top sleeve 185 will vary, depending upon the nature of the sleeve and the size of the coat. As a consequence, a device of the type illustrated in FIG. 27 would have to be provided for each shape variation.

It would be within the scope of the invention to perform the condensing operation on the edge 188 of top sleeve 185 utilizing a slightly modified version of the embodiment of FIGS. 1A-12C. Turning to FIG. 1A, it will be remembered that the front pusher die 13 and the rear pusher die 14 are connected together. In the modified version contemplated, the front pusher die 13 and the rear pusher die 14 would be separate. The rear pusher die 14 would be shiftable by cylinder 20 and the front pusher die 13 would be shiftable by being provided with its own cylinder (not shown). The edges 13*a* and 14*a* of the front pusher die 13 and the rear pusher die 14 would be correspondingly shaped to impart to the flexible needle block assembly 8 a shape similar to that illustrated in FIG. 27 and corresponding to the edge 188 of top sleeve 185. Those portions of front pusher die 13 and rear pusher die 14 having the edges 13*a* and 14*a* could be replaceable portions, provided in corresponding pairs, to configure the flexible needle block assembly 8 to accommodate the uppermost edge of any appropriate top sleeve, regardless of its shape or size. In this way, a single device may be provided which is capable of performing a condensing operation on a range of top sleeve edge shapes.

Modifications may be made in the invention without departing from the spirit of it.

What is claimed is:

1. A condensing and alignment device comprising a base, means on said base supporting a row of needle blocks in side-by-side relationship, at least two fabric engaging needles extending vertically upwardly on each needle block, a resilient O-ring mounted on each needle block facing and abutting the adjacent needle block in said row, said needle blocks of said row being spaced from each other by said O-rings, a condensing cylinder located at one end of said needle block row, said condensing cylinder being operatively attached to at least that needle block at the opposite end of said row, said needle blocks of said row being shiftable by said condensing cylinder from their normal position determined by said O-rings to a condensed position against the action of said O-rings, a press mounted above said needle block row, said press being shiftable between an upper retracted position above said needle block row and a lower extended position abutting said needle block row and said needles thereof, said press being connected to a source of steam, said base adjacent said needle block row having a plurality of perforations connected to a source of vacuum.

2. The condensing and alignment device claimed in claim 1 wherein said support means for said needle block row and said needle block row are normally rectilinear, said support means being flexible, and means to shift said support means and said needle block row from their normal rectilinear orientation to an arcuate concave orientation and to an arcuate convex orientation.

3. The condensing and alignment device claimed in claim 1 wherein said support means for said needle block row and said needle block row are normally rectilinear, said support means being flexible and means to shift said support means and said needle block row to a non-rectilinear configuration.

4. The condensing and alignment device claimed in claim 1 wherein said support means for said needle block row is rigidly rectilinear.

5. The condensing and alignment device claimed in claim 1 wherein said support means for said needle block row is rigidly non-rectilinear.

6. The condensing and alignment device claimed in claim 1 wherein said needle blocks of said row are shifted toward said condensing cylinder when in said condensed position.

7. The condensing and alignment device claimed in claim 1 wherein the needle block located at the longitudinal center of said needle block row is fixed with respect to said means supporting said row, the remaining ones of said needle blocks being shifted toward said fixed needle block when in said condensed position.

8. The condensing and alignment device claimed in claim 1 including a piston within said condensing cylinder, an elongated cable, one end of said cable being affixed to said piston, said cable passing through perforations in said needle blocks of said row thereof, a termination element mounted on the other end of said cable and in abutment with said needle block most remote from said condensing cylinder.

9. The condensing and alignment device claimed in claim 1 including a piston within said condensing cylinder, an elongated cable, one end of said cable being affixed to said piston, said cable passing through perforations in said needle blocks of said row thereof, a termination element mounted on the other end of said cable and in abutment with said needle block most remote from said condensing cylinder, said condensing cylinder having a forward end facing said needle block row, a tubular member mounted on said condensing cylinder forward end and being coaxial with said condensing cylinder, said cable passing through said tubular member, said tubular member having a forward end abutting said needle block nearest said condensing cylinder, said condensing cylinder being axially shiftable.

10. The condensing and alignment device claimed in claim 1 wherein said press has a bottom surface, said bottom surface being covered with a pad of porous resilient material penetrable by said needles of said needle blocks.

11. The condensing and alignment device claimed in claim 1 wherein said press has a bottom surface, said bottom surface being covered with a porous pad having slots formed therein to accommodate said needles of said needle blocks.

12. The condensing and alignment device claimed in claim 1 wherein said press has a bottom surface with slots formed therein to accommodate said needles of said needle blocks.

13. The condensing and alignment device claimed in claim 1 wherein said press has a bottom surface with slots formed therein to accommodate said needles of said needle blocks, means to determine an intermediate position of said press wherein said press is spaced upwardly from said needle blocks and the uppermost ends of the needles of said needle blocks remain in said slots of said press bottom surface.

14. The condensing and alignment device claimed in claim 1 including a fusing tape, means for automatically dispensing a strip of said fusing tape along said row of needle blocks between said needles thereof.

15. The condensing and alignment device claimed in claim 1 including a plurality of spacers, each spacer being configured to be inserted between any two adjacent needle blocks to minimize condensing therebetween when said needle blocks of said row are in said condensed position.

16. The condensing and alignment device claimed in claim 2 wherein the needle block located at the longitudinal center of said needle block row is fixed with respect to said means supporting said row, the remaining ones of said needle blocks being shifted toward said fixed needle block when in said condensed position.

17. The condensing and alignment device claimed in claim 2 including a piston within said condensing cylinder, an elongated cable, one end of said cable being affixed to said piston, said cable passing through perforations in said needle blocks of said row thereof, a termination element mounted on the other end of said cable and in abutment with said needle block most remote from said condensing cylinder, said condensing cylinder having a forward end facing said needle block row, a tubular member mounted on said condensing cylinder forward end and being coaxial with said condensing cylinder, said cable passing through said tubular member, said tubular member having a forward end abutting said needle block nearest said condensing cylinder, said condensing cylinder being axially shiftable.

18. The condensing and alignment device claimed in claim 2 wherein said press has a bottom surface, said bottom surface being covered with a porous pad having slots formed therein to accommodate said needles of said needle blocks.

19. The condensing and alignment device claimed in claim 2 including a fusing tape, means for automatically dispensing a strip of said fusing tape along said row of needle blocks between said needles thereof.

20. The condensing and alignment device claimed in claim 2 wherein said means to shift said support means and said needle block row from their normal rectilinear orientation to an arcuate concave orientation and an arcuate convex orientation comprise first and second pusher dies located to either side of said support means, each of said first and second pusher dies having an arcuate edge, each of said first and second pusher dies being shiftable from a retracted position remote from said support means to an extended position wherein said arcuate edge thereof abuts said support means, said arcuate edge of said first pusher die imparting said concave orientation and said arcuate edge of said second pusher die imparting said convex orientation.

21. The condensing and alignment device claimed in claim 2 including a plurality of spacers, each spacer being configured to be inserted between any two adjacent needle blocks to minimize condensing therebetween when said needle blocks of said row are in said condensed position.

22. The condensing and alignment device claimed in claim 3 wherein said means to shift said support means and said needle block row to a non-rectilinear configuration comprise first and second pusher dies located on either side of said support means, each of said first and second pusher dies having an edge corresponding to said non-rectilinear configuration, said pusher dies having normal unactuated positions wherein said support means is rectilinear and an actuated position wherein said support means is engaged between said edges thereof and shaped thereby to said non-rectilinear configuration.

23. The condensing and alignment device claimed in claim 3 wherein the needle block located at the longitudinal center of said needle block row is fixed with respect to said means supporting said row, the remaining ones of said needle blocks being shifted toward said fixed needle block when in said condensed position.

24. The condensing and alignment device claimed in claim 3 including a piston within said condensing cylinder, an elongated cable, one end of said cable being affixed to said piston, said cable passing through perforations in said needle blocks of said row thereof, a termination element mounted on the other end of said cable and in abutment with said needle block most remote from said condensing cylinder, said condensing cylinder having a forward end facing said needle block row, a tubular member mounted on said condensing cylinder forward end and being coaxial with said condensing cylinder, said cable passing through said tubular member, said tubular member having a forward end abutting said needle block nearest said condensing cylinder, said condensing cylinder being axially shiftable.

25. The condensing and alignment device claimed in claim 3 wherein said press has a bottom surface, said bottom surface being covered with a pad of porous resilient material penetrable by said needles of said needle blocks.

26. The condensing and alignment device claimed in claim 3 wherein said press has a bottom surface with slots formed therein to accommodate said needles of said needle blocks.

27. The condensing and alignment device claimed in claim 3 wherein said press has a bottom surface with slots formed therein to accommodate said needles of said needle blocks, means to determine an intermediate position of said press wherein said press is spaced upwardly from said needle blocks and the uppermost ends of the needles of said needle blocks remain in said slots of said press bottom surface.

28. The condensing and alignment device claimed in claim 3 including a fusing tape, means for automatically dispensing a strip of said fusing tape along said row of needle blocks between said needles thereof.

29. The condensing and alignment device claimed in claim 3 including a plurality of spacers, each spacer being configured to be inserted between any two adjacent needle blocks to minimize condensing therebetween when said needle blocks of said row are in said condensed position.

30. The condensing and alignment device claimed in claim 4 wherein said needle blocks of said row are shifted toward said condensing cylinder when in said condensed position.

31. The condensing and alignment device claimed in claim 4 wherein the needle block located at the longitudinal center of said needle block row is fixed with respect to said means supporting said row, the remaining ones of said needle blocks being shifted toward said fixed needle block when in said condensed position.

32. The condensing and alignment device claimed in claim 4 including a piston within said condensing cylinder, an elongated cable, one end of said cable being affixed to said piston, said cable passing through perforations in said needle blocks of said row thereof, a termination element mounted on the other end of said cable and in abutment with said needle block most remote from said condensing cylinder.

33. The condensing and alignment device claimed in claim 4 including a piston within said condensing cylinder, an elongated cable, one end of said cable being affixed to said piston, said cable passing through perforations in said needle blocks of said row thereof, a termination element mounted on the other end of said cable and in abutment with said needle block most remote from said condensing cylinder, said condensing cylinder having a forward end facing said needle block row, a tubular member mounted on said condensing cylinder forward end and being coaxial with said condensing cylinder, said cable passing through said tubular member, said tubular member having a forward end abutting said needle block nearest said condensing cylinder, said condensing cylinder being axially shiftable.

34. The condensing and alignment device claimed in claim 4 wherein said press has a bottom surface, said bottom surface being covered with a pad of porous resilient material penetrable by said needles of said needle blocks.

35. The condensing and alignment device claimed in claim 4 wherein said press has a bottom surface with slots formed therein to accommodate said needles of said needle blocks.

36. The condensing and alignment device claimed in claim 4 wherein said press has a bottom surface with slots formed therein to accommodate said needles of said needle blocks, means to determine an intermediate position of said press wherein said press is spaced upwardly from said needle blocks and the uppermost ends of the needles of said needle blocks remain in said slots of said press bottom surface.

37. The condensing and alignment device claimed in claim 4 including a fusing tape, means for automatically dispensing a strip of said fusing tape along said row of needle blocks between said needles thereof.

38. The condensing and alignment device claimed in claim 4 including a plurality of spacers, each spacer being configured to be inserted between any two adjacent needle blocks to minimize condensing therebetween when said needle blocks of said row are in said condensed position.

39. The condensing and alignment device claimed in claim 5 wherein the needle block located at the longitudinal center of said needle block row is fixed with respect to said means supporting said row, the remaining ones of said needle blocks being shifted toward said fixed needle block when in said condensed position.

40. The condensing and alignment device claimed in claim 5 including a piston within said condensing cylinder, an elongated cable, one end of said cable being affixed to said piston, said cable passing through perforations in said needle blocks of said row thereof, a termination element mounted on the other end of said cable and in abutment with said needle block most remote from said condensing cylinder.

41. The condensing and alignment device claimed in claim 5 including a piston within said condensing cylinder, an elongated cable, one end of said cable being affixed to said piston, said cable passing through perforations in said needle blocks of said row thereof, a termination element mounted on the other end of said cable and in abutment with said needle block most remote from said condensing cylinder, said condensing cylinder having a forward end facing said needle block row, a tubular member mounted on said condensing cylinder forward end and being coaxial with said condensing cylinder, said cable passing through said tubular member, said tubular member having a forward end abutting said needle block nearest said condensing cylinder, said condensing cylinder being axially shiftable.

42. The condensing and alignment device claimed in claim 5 wherein said press has a bottom surface, said bottom surface being covered with a pad of porous resilient material penetrable by said needles of said needle blocks.

43. The condensing and alignment device claimed in claim 5 wherein said press has a bottom surface with slots formed therein to accommodate said needles of said needle blocks.

44. The condensing and alignment device claimed in claim 5 wherein said press has a bottom surface with slots formed therein to accommodate said needles of said needle blocks, means to determine an intermediate position of said press wherein said press is spaced upwardly from said needle blocks and the uppermost ends of the needles of said needle blocks remain in said slots of said press bottom surface.

45. The condensing and alignment device claimed in claim 5 including a fusing tape, means for automatically dispensing a strip of said fusing tape along said row of needle blocks between said needles thereof.

46. The condensing and alignment device claimed in claim 5 including a plurality of spacers, each spacer being configured to be inserted between any two adjacent needle blocks to minimize condensing therebetween when said needle blocks of said row are in said condensed position.

* * * * *